US008927797B2

(12) United States Patent
Sarker

(10) Patent No.: US 8,927,797 B2
(45) Date of Patent: Jan. 6, 2015

(54) METHOD FOR CONVERTING WASTE PLASTIC TO LOWER-MOLECULAR WEIGHT HYDROCARBONS, PARTICULARLY HYDROCARBON FUEL MATERIALS, AND THE HYDROCARBON MATERIAL PRODUCED THEREBY

(75) Inventor: Moinuddin Sarker, Bridgeport, CT (US)

(73) Assignee: Natural State Research, Inc., Pawling, NY (US)

( * ) Notice: Subject to any disclaimer, the term of this patent is extended or adjusted under 35 U.S.C. 154(b) by 933 days.

(21) Appl. No.: 13/019,725

(22) Filed: Feb. 2, 2011

(65) Prior Publication Data

US 2011/0124932 A1 May 26, 2011

Related U.S. Application Data

(63) Continuation of application No. 12/471,717, filed on May 26, 2009, now abandoned.

(60) Provisional application No. 61/057,352, filed on May 30, 2008.

(51) Int. Cl.
*C10G 1/10* (2006.01)

(52) U.S. Cl.
CPC ..... *C10G 1/10* (2013.01)
USPC ..... 585/241; 201/7; 201/8; 201/23; 201/25; 201/30

(58) Field of Classification Search
USPC ..... 585/241; 201/7, 8, 23, 25, 30
See application file for complete search history.

(56) References Cited

U.S. PATENT DOCUMENTS

| | | | | |
|---|---|---|---|---|
| 3,901,951 | A | 8/1975 | Nishizaki | |
| 4,584,421 | A * | 4/1986 | Saito et al. | 585/241 |
| 4,851,601 | A * | 7/1989 | Fukuda et al. | 585/241 |
| 5,079,385 | A | 1/1992 | Wu | |
| 5,208,404 | A | 5/1993 | Lu | |
| 5,363,723 | A * | 11/1994 | Hoffman | 74/606 R |
| 5,368,723 | A | 11/1994 | Takahashi et al. | |
| 5,451,297 | A | 9/1995 | Roy | |
| 5,504,259 | A | 4/1996 | Diebold et al. | |
| 5,597,451 | A * | 1/1997 | Nagai et al. | 201/4 |
| 5,608,136 | A * | 3/1997 | Maezawa et al. | 588/316 |
| 5,744,668 | A | 4/1998 | Zhou et al. | |
| 5,753,086 | A | 5/1998 | Guffey et al. | |
| 5,771,821 | A | 6/1998 | Zhuravsky et al. | |
| 5,811,606 | A | 9/1998 | Yang | |
| 5,821,395 | A | 10/1998 | Price et al. | |
| 5,849,964 | A | 12/1998 | Holighaus et al. | |
| 5,856,599 | A | 1/1999 | Kuroki | |
| 5,951,940 | A | 9/1999 | Nosker et al. | |
| 5,969,201 | A | 10/1999 | Kalnes et al. | |
| 6,011,187 | A | 1/2000 | Horizoe et al. | |
| 6,060,631 | A | 5/2000 | James, Jr. et al. | |
| 6,172,271 | B1 * | 1/2001 | Horizoe et al. | 585/241 |
| 6,172,275 | B1 * | 1/2001 | Tadauchi et al. | 423/481 |
| 6,255,547 | B1 * | 7/2001 | Smuda | 585/241 |
| 6,270,630 | B1 | 8/2001 | Xing | |
| 6,774,271 | B2 | 8/2004 | Jiang | |
| 6,777,581 | B1 * | 8/2004 | Zmuda | 585/241 |
| 6,822,126 | B2 | 11/2004 | Miller | |
| 6,861,568 | B1 * | 3/2005 | Guffey et al. | 585/241 |
| 6,866,830 | B2 * | 3/2005 | Kwak | 422/610 |
| 7,048,832 | B2 | 5/2006 | Lemmons et al. | |
| 7,425,315 | B2 | 9/2008 | Kruesi | |
| 7,531,703 | B2 * | 5/2009 | Ramesh et al. | 585/241 |
| 7,626,062 | B2 * | 12/2009 | Carner | 585/241 |
| 7,691,344 | B2 * | 4/2010 | Yoshimura | 422/198 |
| 2007/0289862 | A1 | 12/2007 | Grispin | |
| 2008/0099323 | A1 * | 5/2008 | Kitamura et al. | 201/21 |
| 2008/0200738 | A1 | 8/2008 | Grispin | |
| 2009/0299110 | A1 | 12/2009 | Sarker | |
| 2011/0259726 | A1 | 10/2011 | Podeszfa et al. | |
| 2012/0310023 | A1 | 12/2012 | Huang et al. | |
| 2014/0275667 | A1 | 9/2014 | Sarker | |

FOREIGN PATENT DOCUMENTS

| | | | |
|---|---|---|---|
| JP | H 10324770 | A | 12/1998 |
| JP | 2000-129270 | A | 5/2000 |
| JP | 2000-176936 | A | 6/2000 |
| JP | 2003-253277 | A | 9/2003 |
| JP | 2007-077324 | A | 3/2007 |
| JP | 2008-231229 | A | 10/2008 |

OTHER PUBLICATIONS

4R Sustainability, Ind. Conversion technology: A complement to plastic recycling. Apr. 2011.

Buekens, A. Introduction to Feedstock Recycling of Plastics. In Feedstock Recycling and Pyrolysis of Waste Plastics. Edited by J. Scheirs and W. Kaminsky. 2006. John Wiley & Sons, Ltd. pp. 1, 4-41.

Sarker, M. Generation of Transportation Fuel from Solid Municipal Wast Plastics. World Energy Congress Meeting in Montreal QC Canada conference proceedings. Sep. 12, 2010-Sep. 16, 2010.

Sarker. Municipal Waste Plastic conversion into Different Category Liquid Hydrocarbon Fuel. Natural States Research, Inc., USA. In book Chemistry, Emission Control, Radioactive Pollution and Indoor Air Quality, pp. 45-80. ISBN: 978-953-307-316-3. Jul. 27, 2011. DOI: 10.5772/16276.

(Continued)

*Primary Examiner* — Nina Bhat
(74) *Attorney, Agent, or Firm* — Wilson Sonsini Goodrich & Rosati

(57) ABSTRACT

The method produces a hydrocarbonaceous fluid (a liquid mixture of hydrocarbons, or in other words a mixture of hydrocarbons which is liquid at ambient room temperature and atmospheric pressure), which functionally is a liquid hydrocarbon fuel, from a feed of waste plastic. The method can comprise the steps of: (step 1) melting a feed of substantially solid waste plastic in an aerobic atmosphere (for instance, air) whereby a waste-plastic melt is produced; (step 2) distilling at least a portion of the waste-plastic melt whereby a hydrocarbonaceous distillate is produced; and (step 3) collecting the hydrocarbonaceous distillate. That distillate is generally referred to above as a condensate. The method can include the step of comminuting the feed of substantially solid waste plastic into pieces substantially no greater than about 1.5 $cm^2$ prior to step 1. The method can also include the step of adding an effective amount of a cracking catalyst to the waste plastic prior to step 2.

21 Claims, No Drawings

(56) References Cited

OTHER PUBLICATIONS

Sugiyama, et al. A process of municipal waste plastic, thermal degradation into fuel oil. in 1st International Symposium on Feedstock Recycling of Plastics (ISFR'99), Research Association for Feedstock Recycling of Plastics, Sendai, Japan, Oct. 31-Nov. 3, 1999, 205-208.
The Cynar Technology. Process Flow Diagram. Available at http://www.cynarplc.com/cynar_technology.asp. Accessed Oct. 16, 2012.
United Nations Environment Programme. Converting Waste Plastics Into a Resource: A Compendium of Technologies. Copyright 2009.
U.S. Appl. No. 13/671,484, filed Nov. 7, 2012, Sarker.
Miskolczi, et al. Hydrocarbon fractions from plastic wastes for refinery and petrochemical industry. 19th World Petroleum Congress, Spain 2008, Forum 10: Unconventional crude oils and feedstocks to refineries. Conference Date: Jun. 29-Jul. 3, 2008.
Sarker, et al. Abundant High-Density Polyethylene (HDPE-2) Turns into Fuel by Using of HZSM-5 Catalyst. Journal of Fundamentals of Renewable Energy and Applications. Sep. 2011; 1:R110201.
Sarker, et al. High density polyethylene (HDPE) waste plastic conversion into alternative fuel. Journal of Environmental Research and Development. 2012; 7:1-9.
Sarker, et al. New Alternative Energy from Solid Waste Plastic. Developments in Renewable Energy Technology ( ICDRET), 2009 1st International Conference. Conference Date: Dec. 17-19, 2009. 1-4.
Sarker, et al. Thermal Conversion of Waste Plastics (HDPE, PP, and PS) to produce mixture of hydrocarbons. American Journal of Environmental Engineering. 2012; 2(5):128-136.
Sarker, et al. Thermal Degradation of PVC & Mixed Waste Plastics to Produce Mixture of Hydrocarbon Fuel. Journal of Applied Chemical Science. 2012; 4(12):9-17.
Walendziewski. Continuous flow cracking of waste plastics. Fuel Processing Technology, Aug. 25, 2005; 86(12-13):1265-1278.
International search report and written opinion dated Jul. 16, 2009 for PCT/US2009/003200.
International search report and written opinion dated Mar. 18, 2013 for PCT/US2012/063991.
Office action dated Aug. 3, 2010 for U.S. Appl. No. 12/471,717.
International search report and written opinion dated Aug. 14, 2014 for PCT/US2014/022747.
Sarker, et al. Mixture of LDPE, PP and PS waste plastics into fuel by thermolysis process. International Journal of Engineering and Technology. 2013; 1(1):1-16.
Sarker, et al. Polypropylene waste plastic into light fractional gasoline grade fuel for vehicle by using two step thermal process. International Journal of Forest, Soil and Erosion. 2012; 2(4):186-191.
Panda, et al. Thermolysis of waste plastics to liquid fuel A suitable method for plastic waste management and manufacture of value added products—A world prospective. Renewable and Sustainable Energy Reviews. 2010; 14:233-248.

* cited by examiner

METHOD FOR CONVERTING WASTE PLASTIC TO LOWER-MOLECULAR WEIGHT HYDROCARBONS, PARTICULARLY HYDROCARBON FUEL MATERIALS, AND THE HYDROCARBON MATERIAL PRODUCED THEREBY

CROSS-REFERENCE TO RELATED APPLICATIONS

This application is a continuation of U.S. patent application Ser. No. 12/471,717, filed on May 26, 2009, now abandoned, which applications claim priority to U.S. Provisional Patent Application No. 61/057,352, filed on May 30, 2008.

BACKGROUND OF THE INVENTION

The present invention relates to methods for the conversion of waste plastic to lower molecular weight hydrocarbon materials, particularly valuable hydrocarbon materials such as hydrocarbon fuel materials. The present invention relates in particular to the decomposition of hydrocarbon polymers of waste plastics, which have a high molecular weights (long carbon chain lengths), to lower molecular weight hydrocarbons, particularly to hydrocarbons in the gasoline range ($C_7$ to $C_{11}$ hydrocarbons) or to hydrocarbons in the diesel fuel range (somewhat higher carbon chain length).

The production of hydrocarbon fuels (gasoline, diesel and the like) via catalyzed, and non-catalyzed thermal, decompositions of waste plastic, followed by separation and collection of the fuel product, is known, and has been known for decades. Pre-decomposition sorting and identification of the waste plastics is also well known.

The environmental benefits of producing fuel and other valuable low molecular weight hydrocarbon materials while eliminating plastic waste via the decomposition, or breaking down, of the polymer molecules of plastics to fuel-range hydrocarbons and/or other valuable hydrocarbons, has long been recognized, and has been commercialized. Some early commercial installations in Europe were short-lived for economic reasons, but commercial installations continue in Japan and other countries.

Major drawbacks or difficulties encountered in commercial-scale processes include: (a) chlorine removal when chlorine-containing polyvinyl chloride is among the plastic wastes; (b) heat gradients due to poor heat conductivity of plastics, resulting in char accumulation at heat transfer surfaces; and (c) economics, varying from high catalyst costs/consumption to high energy consumption. Further, the implementations of commercial-scale processes are also adversely impacted by the complexities of the installations required and the sophistications of their operations.

The prevailing high costs of hydrocarbon fuels and the environmental desirability of eliminating waste plastic combine to demand efficient yet simple and uncomplicated methods for achieving these goals. Governmental plastic waste elimination requirements, particularly in countries other than the U.S., apparently were significant motivations for existing commercial plastic-decomposition installations, particularly outside of the U.S. The increasing cost of hydrocarbon fuels obviously augments such incentives.

Further, the current major alternative fuel sources being heavily explored, such as for instance crop-plant biomass fuels (bio-fuels) and wind generators, have inherent drawbacks, including without limitation (a) the diversion of crop-producing resources (including arable land) from food production to fuel production, (b) the re-engineering of machinery that is often required in order to run on bio-fuels and (c) the harmful penetration into air spaces normally inhabited almost exclusively by our bird population and the documented incidents of devastation of bird populations, particularly when windmills and the like are placed along major migratory routes.

SUMMARY OF THE INVENTION

The present invention provides a method in which plastic, particularly waste plastic, is melted (including by heating to form a liquid slurry (thermal liquification)), and then distilled, optionally in the presence of a cracking catalyst, wherein the distillate is condensed and recovered as a condensate, which condensate is functionally a liquid hydrocarbon fuel. The present invention also includes the material produced by the present method.

DETAILED DESCRIPTION OF THE INVENTION

The present process broadly comprises the steps of (1) melting waste plastics in the presence, or absence, of a cracking catalyst, (2) followed by volatilization and distillation, and then (3) condensation, and optionally further refinement of the condensate by filtration, which may be followed by subsequent distillation(s) of the filtrate. The present process includes a split process which comprises the steps of: (a) uncatalyzed thermal liquification (melting, decomposition) of shredded plastic in a closed furnace without an inert gas blanket, which produces a slurry; (b) partial cooling of the slurry; (c) addition of a cracking catalyst to the slurry; (d) transfer of the still-hot, catalyst-containing slurry to a distillation and condensation unit; (e) heating of the slurry in the condensation unit to emit volatile material therefrom; (f) condensing the volatiles and recovering them in a separate receptacle; and (g) preferably routing the slurry residue (portion not volatilized) back into a fresh batch of slurry (which then undergoes another catalyzed distillation/condensation process). The split process of liquification, condensation and distillation process to recover liquid fuel-range hydrocarbons is distinctively simple. The present process includes a basic process which comprises the steps of: (A) heating shredded plastic in a vessel open to a condensation unit, without an gas blanket, in the presence, or absence, of a cracking catalyst, through the stages of melting and then vaporization, (B) condensing the vapor in the condensation unit and (C) collection of the condensate produced, optionally followed by filtration and at least one subsequent re-distillation. The basic process of heating through vaporization (melting and vaporizing), distillation and condensation to recover liquid fuel-range hydrocarbons is even more distinctively simple. The distillation may be a fractional distillation, but in preferred embodiments it is a simple distillation.

There are several aspects as to the simplicity of the split-process process steps. No addition of chemicals is made to the plastic liquification step. The HZSM-5 Zeolite or other efficient cracking catalyst used subsequently is a readily-available conventional catalyst. Slurry residues after the distillation and condensation step are routed back into one or more other slurries and reprocessed. Since the catalyst remains in the residue, it is available for reuse when the residue is routed back to fresh batches of slurry, and it preferably is not otherwise subject to recovery efforts. (The HZSM-5 Zeolite or other efficient cracking catalyst is also the catalyst used in the basic-process process of the present invention when that process is catalyzed.)

Waste Plastics

The present process is believed capable of being used with all types of waste plastics, including without limitation thermoplastic and thermoset waste plastics, and combinations of types of plastics. The types of plastics commonly encountered in waste-plastic feedstock include, without limitation, low-density polyethylene, high-density polyethylene, polypropylene, polystyrene, polyethylene terephthalate and the like. Plastics are polymers which are often modified or compounded with additives (including colorants) to form useful materials. The compounded product is generally itself is called and considered a plastic. The term "plastic" as used herein includes both modified (compounded) and unmodified plastic.

Thermoplastic polymers can be heated and formed, then heated and formed again and again. The shape of the polymer molecules are generally linear or slightly branched, whereby the molecules can flow under pressure when heated above their melting point.

Thermoset polymers undergo a chemical change when they are heated, creating a three-dimensional network. After they are heated and formed, these molecules cannot be reheated and re-formed.

The plastics most commonly used for consumer products packaging, listed here with their identification American Plastic Council codes, are often found in the typical waste-plastic feedstock. Code 1 (PETE) is polyethylene terephthalate (PET), which is often used for carbonated beverage and water containers, and some waterproof packaging. Code 2 (HDPE) is high-density polyethylene, which is often used for milk, detergent and oil bottles, toys and plastic bags. HDPE naturally translucent. Code 3 (V) is vinyl/polyvinyl chloride (PVC), which is often used for food wrap, vegetable oil bottles, blister packages. It is naturally clear. PVC contains bonded chlorine atoms which, upon degradation of the polymer, must be separated and particularly handled. Code 4 (LDPE) is low-density polyethylene, which is often used for plastic bags, shrink wrap, and garment bags. It is chemically similar to HDPE but it is less dense and more flexible. Most polyethylene film is made from LDPE. Code 5 (PP) is polypropylene, which is often used for refrigerated containers, plastic bags, bottle tops, and at times for carpets and certain food wrap materials. Code 6 (PS) is polystyrene, which is often used for disposable utensils, meat packing and protective packing materials. Code 7 (Other) includes layered or mixed plastic, or fairly common plastics used in packaging which do not lend themselves well to mechanical recycling such as polycarbonate (PC) and acrylonitrile-butadiene-styrene (ABS). There are many plastics which do not fit into the numbering system that identifies plastics used in consumer containers. There are thousands of different varieties of plastics, or mixtures of plastics, which have been, and continue to be, developed to suit the needs of particular products.

In the process of the present invention, such waste plastics are collected, optionally sorted by the type of plastic, cleaned of contaminants and, when required or preferred, cut or otherwise divided into smaller pieces prior to subjecting the plastic to the process of the present invention.

Pre-Melting (Liquification) Handling

Prior to thermal liquification, the waste plastic is collected, cleaned of contaminants, and at times sorted by the type of plastic. The sorting may include not only the sorting by the type of plastic but also sorting by the type of fillers used therein. The present process does not, however, exclude the use of an indiscrimate plastic feedstock, i.e., random accumulations of waste plastic, rather than groups of the same or similar plastics. The plastics may be identified by any stamped American Plastic Council recycle codes (currently PETE 1, HDPE 2, PVC 3, LDPE 4, PP 5, PS 6), and where a recycle code is not available, by (a) appearance, thickness and other observable characteristics and/or (b) instrumental analysis. The types of instrumental analyses useful include, without limitation, gas chromatography, mass spectrometry, thermo gravimetric analysis and elemental analysis. The recycle-code and observational identifications may of course be conducted before or after cleaning, while the instrumental analysis methods normally require scrupulously clean and uncontaminated samples. It is noted here that thermo gravimetric analysis an on-set temperature characteristic of the sample which is useful for the selection of the thermal liquification temperature.

Split-Process Thermal Liquidation

The thermal liquification of waste plastics is carried out using plastic which has been cleaned of all non-plastic material (paper labels, contaminants etc.) and cut or otherwise divided into pieces of from about 0.5 to about 1.5 $cm^2$ in size. In laboratory-scale examples, the weight of the plastic pieces processed in a single batch typically ranges from about 25 to 125 grams depending on the thickness and density of the plastic pieces, and the size of crucible used (250 ml, 500 ml and 600 ml crucibles being most commonly used).

The temperatures used for the liquification depends on the melting onset of the plastics, as determined by its Thermogravimetric Analysis (TGA) graph, thickness of the plastic pieces and whether the plastics are thermoplastics or thermoset plastics.

The final (high) temperature in the liquification step is typically within the range of from about 370 to about 420° C. (internal furnace temperature), reached with a ramping rate of from about 5 to about 10° C. per minute, and a hold or dwell time at the final (high) temperature of from about 20 or 30 minutes to about 60 minutes. The liquification is carried out in a closed heating chamber equipped with appropriate controls for monitoring and controlling the temperature and time. The time elapsed to reach the final (high) temperature is typically from about 30 to about 40 minutes, depending on the ramping rate, and the size and thickness of the plastic pieces and crucible used. The cooling rate is typically about 1.2° C. The total liquification step can take from about 2 to about 2.5 hours. The liquification is conducted in laboratory-scale examples in a closed-chamber muffle furnace in a covered crucible, in the presence of a normal air atmosphere (rather than a blanket of inert gas and the like) and under ambient air pressure. No catalysts or other chemicals are used in the thermal liquification step.

Split-Process Catalyzed Distillation and Condensation

The catalyzed distillation and condensation step is a simple (not fractional or vacuum) distillation and condensation, carried out under ambient air pressure, using the expedient of a cracking catalyst in the slurry. The distillation/condensation is generally conducted until the residual slurry becomes too overly viscous for the continuance of the procedure.

EXAMPLE 1

Waste plastics consisting of the body of a used one-gallon plastic milk bottle and a portion of the body of a used plastic liquid soap container were selected as the samples. The caps of these containers were not included. The milk bottle was made of HDPE with an included colorant. The liquid soap container was made of HDPE. These samples, after removal of non-plastic elements (paper labels and the like) were cleaned in a dishwasher using a phosphate-free, non-foaming powder detergent in a 40-50 minute plastic-wash low heat cycle and then air dried at ambient room temperature. After drying, the samples cut into pieces of approximately 1-2 $cm^2$. The samples were then placed into a ceramic 250 ml. crucible with cover of a pre-loading weight of 170.5 grams (tare of 170.5). The weight of the samples, less tare, was then determined to be 80.6 grams. The loaded and covered crucible was placed in a programmable Barnstead/Thermolyte F6000 muffle furnace, model F6038CM, which is commercially available from Barnstead/Thermolyte Corp. of Dubuque, Iowa, which was positioned under a standard laboratory gas (fume) hood. The furnace was set at an initial temperature of 35° C. and programmed for a target/final temperature of 420° C., ramping rate of 10° C. per minute, and a hold or dwell time of 20 minutes at final temperature. The time versus temperature was recorded, and the elapsed times and rates determined therefrom are set forth in Table 1 below.

TABLE 1

| Event | Time Elapsed | Actual Rate |
|---|---|---|
| Ramping from 35° C. to 420° C. | 39 min. | 9.9° C./min. |
| Dwell at 420° C. | 20 min. | N/A |
| Cool from 420° C. to 360° C. | 50 min. | 1.2° C./min. |
| (Ramping onset to cool to 360° C.) | (109 min.) | |

The samples, which were then in a liquefied slurry form, were removed from the furnace in the covered crucible immediately upon cooling to 360° C. and the weighed. The weight of the liquefied samples was 78.7 grams, denoting a loss of 1.9 grams of sample (2.4 wt. percent) to volatilization, during liquification. Using the pre-weighed spoon, funnel and flask, the slurry was then poured into a 1000 ml double neck round bottom boiling flask. Since this laboratory-scale transfer technique does not approach a quantitative transferred to the round-bottom flask was determined by weight differential (weight of the flask and slurry less the flask's empty weight) to be 69.9 grams. Here the amount of slurry left clinging to the apparatus was also determined by weight differential to be about 4.3 grams in the crucible, about 3.8 grams in the funnel, and about 0.7 grams on the spoon, which in combination equals the 8.8 grams determined above to be lost in the transfer. Then an HZSM-5 Zeolite cracking catalyst, which is commercially available from Sigma-Aldrich, was added to the slurry in the amount of about 0.7 grams (1.0 wt. percent) and the flask containing the now catalyzed slurry was placed in a heating mantle whereat, after cleaning and greasing (with high vacuum grease) the glass joints, a cold-water cooled condenser (connected to a water circulator) was mounted onto the flask, and the second neck of the flask was covered with a puncture-vented Parafilm. The flask-mounted or upright condenser opened to a second water-cooled condenser mounted in a downwardly-sloped position which emptied its condensed fluid into a collection vessel. In this set up both a 600 mm long Liebig condenser (water-cooled concentric straight-tube vapor condenser) and a 400 mm long Graham condenser (water-cooled spiral tube vapor condenser) were used. The water temperature of the circulator was set at 20° C. The heating mantle, with its power initially set at a Variac range of 60%, was turned on. Slurry boiling started after about 35 minutes of elapsed time, and condensation started after about 5 additional minutes. About 50 drops of condensate were recovered at the initial 60% Variac setting, and then a further 60 drops of condensate were recovered at a higher 70% Variac setting. The distillation/condensation process was allowed to proceed until no further condensate was recovered at the higher 70% Variac setting. The elapsed condensation time from commencement to end point was about 2.7 hours. The amount of condensate recovered was 59.0 grams, which was about 84 wt. percent of the post-transfer slurry, and 10.9 grams of residue (about 16 wt. percent of the post-transfer slurry) remained in the flask. The residue was collected for later recycling back into a fresh batch of slurry. The condensate was ignitable and had a kerosene-type of odor.

EXAMPLE 2

Section 1, Samples 1 to 71—Split-Process Slurry Formation

Using the type of slurry-formation method described in Example 1 above, with adjustments in temperatures and dwell times appropriate to the various plastics, plastic samples of several plastic types and combinations of plastics were converted to liquid slurries as the first step in their conversion to fuel-range type of liquid hydrocarbons. The identification of the plastic in each sample, the original sample weight (W1) in grams, the resultant slurry weight (W2) in grams and slurry yield Y1 in percentage (W2/W1×100) for each Sample are set forth below in Table 2. The samples identified as a "Group" is a reference to a type of non-coded plastic characterized by observation and the like. The group characteristics are listed in Table 5 below. Sample 10 was, as indicated, taken from a black plastic hanger of unknown plastic type. The designation "b.bin" in the identification of the plastic of Samples 38-42 refers to the source of the plastic sample, which was a garbage bin. The losses to volatilization (such as the escape of low molecular weight hydrocarbons) during the slurry-formation step reflected in the yields seen in Table 2 are preferably captured and recovered, although such a step was not implemented in this Example 2.

TABLE 2

| Sample No. | Plastic | W1 (gm) | W2 (gm) | Y1 (%) |
|---|---|---|---|---|
| 1 | HDPE | 300.0 | 293.3 | 98.8 |
| 2 | HDPE | 322.4 | 281.6 | 87.3 |
| 3 | HDPE | 319.9 | 280.2 | 87.6 |
| 4 | HDPE | 278.5 | 249.7 | 89.6 |
| 5 | HDPE | 279.7 | 255.8 | 91.4 |
| 6 | LDPE | 220.5 | 214.3 | 97.2 |
| 7 | LDPE | 269.9 | 211.8 | 78.5 |
| 8 | LDPE | 210.2 | 175.7 | 83.9 |
| 9 | PP | 184.7 | 172.4 | 93.3 |
| 10 | PP | 213.2 | 211.9 | 99.4 |
| 11 | PP | 262.9 | 252.3 | 96.0 |
| 12 | PP | 125.0 | 119.3 | 95.4 |
| 13 | PP | 272.3 | 258.9 | 95.1 |
| 14 | HDPE | 184.1 | 174.1 | 94.6 |
| 15 | PP | 161.9 | 87.7 | 54.2 |
| 16 | LDPE | 175.0 | 170.0 | 97.1 |
| 17 | HDPE | 198.0 | 189.1 | 95.5 |
| 18 | LDPE | 226.4 | 216.4 | 95.6 |
| 19 | Group 3 | 370.0 | 350.0 | 94.6 |
| 20 | PS | 309.6 | 239.6 | 77.4 |
| 21 | PS | 393.3 | 372.4 | 94.7 |
| 22 | PS | 214.4 | 163.5 | 76.3 |
| 23 | PS | 220.4 | 219.4 | 99.5 |
| 24 | PS | 97.7 | 97.7 | 100 |
| 25 | PS | 257.0 | 257.0 | 100 |
| 26 | PS | 199.3 | 199.3 | 100 |
| 28 | Group 3 | 250.8 | 231.9 | 92.2 |
| 29 | Group 3 | 254.9 | 250.8 | 98.4 |
| 30 | Group 3 | 285.3 | 280.8 | 98.4 |
| 31 | Group 9, 10 | 332.0 | 185.8 | 60.0 |
| 32 | Group 9, 10 | 254.1 | 143.1 | 56.7 |
| 33 | Group 9, 10 | 200.7 | 166 | 82.7 |

TABLE 2-continued

| Sample No. | Plastic | W1 (gm) | W2 (gm) | Y1 (%) |
|---|---|---|---|---|
| 34 | Group 9, 10 | 215.1 | 188.1 | 87.4 |
| 35 | Group 9, 10 | 268.6 | 240.9 | 89.7 |
| 36 | Group 9, 10 | 327.6 | 310.5 | 94.8 |
| 37 | (Black hanger) | 266.3 | 183.1 | 68.8 |
| 38 | LDPE (g. bin) | 290.6 | 275.3 | 94.7 |
| 39 | LDPE (g. bin) | 330.2 | 321.3 | 97.3 |
| 40 | LDPE (g. bin) | 339.6 | 327.4 | 96.4 |
| 41 | LDPE (g. bin) | 319.5 | 315.4 | 98.7 |
| 42 | LDPE (g. bin) | 358.8 | 353.7 | 98.6 |
| 43 | Group 8 | 318.0 | 267.7 | 84.2 |
| 44 | Group 8 | 713.0 | 413.0 | 57.9 |
| 45 | Group 5 | 272.8 | 211.3 | 77.5 |
| 46 | HDPE | 292.5 | 250.0 | 85.5 |
| 47 | PS | 458.1 | 246.7 | 53.9 |
| 48 | Group 5 | 295.4 | 219.7 | 74.4 |
| 49 | Group 5 | 251.6 | 228.3 | 90.7 |
| 50 | Group 5 | 207.2 | 194.2 | 93.7 |
| 51 | Group 5 | 338.5 | 225.3 | 66.6 |
| 52 | Group 4 | 223.5 | 201.2 | 90.0 |
| 53 | Group 4 | 255.4 | 234.9 | 92.0 |
| 54 | Group 4 | 298.2 | 223.0 | 74.8 |
| 55 | Group 4 | 226.3 | 203.9 | 90.1 |
| 56 | Group 4 | 208.2 | 197.9 | 95.1 |
| 57 | Group 4 | 205.4 | 188.2 | 91.6 |
| 58 | Group 6 | 240.1 | 220.7 | 91.9 |
| 59 | Group 6 | 254.2 | 245.6 | 96.6 |
| 60 | Group 6 | 244.0 | 185.8 | 76.1 |
| 61 | Group 6 | 268.5 | 183.4 | 68.3 |
| 62 | Group 11 | 235.2 | 203.0 | 86.3 |
| 63 | Group 11 | 210.6 | 209.1 | 99.3 |
| 64 | Group 11 | 201.4 | 186.9 | 92.8 |
| 65 | Group 11 | 222.9 | 214.7 | 96.3 |
| 66 | Group 11 | 239.0 | 229.5 | 96.0 |
| 67 | Group 11 | 232.2 | 218.4 | 94.1 |
| 68 | Group 11 | 243.6 | 233.3 | 95.8 |
| 69 | LDPE, HDPE, PP, PS | 300.0 | 293.1 | 97.7 |
| 70 | Group 2 | 65 | 54.7 | 84.2 |
| 71 | Group 1 | 65 | 58.7 | 90.3 |

EXAMPLE 2

Section 2, Samples 1 to 71—Split-Process Catalyzed Distillation/Condensation The slurries produced as described above in the first section of this Example 2, and as reported in Table 2, were, using the type of method described in Example 1, dosed with one weight percent of the cracking catalyst, distilled and condensed, alone or together with the residue from a prior condensation which is referred to as "old slurry". The identification of the plastic in each sample, pre-distillation fresh slurry weight (W2) in grams, the old slurry (if any) weight (W3) in grams, the combined fresh and old slurry weight (W2+W3) in grams, the recovered condensate weight (W4) in grams, the recovered condensate yield (Y2) in percentage (W4/(W2+W3)×100), the post-condensation recovered residual slurry weight (W5) in grams, and recovered post-condensation residual slurry yield (Y3) in percentage (W5/(W3+W4)×100) for each Sample are set forth below in Table 3. (It is noted here that the recovered post-condensation slurries are typically extremely viscous, and these high viscosities preclude further catalyzed distillation/condensation of the hydrocarbon materials left therein.) As seen from the data of Table 3 below, the combined yields of recovered condensate and post-condensation recovered residue are less than 100 percent, and the shortfall is a combination of material left on the equipment and escaped volatiles (low molecular weight hydrocarbons, such as C1 to C4 natural gas), although recovery of such volatiles is within preferred embodiments of the present process. The identifications of the samples are already discussed above for the data listed in Table 2.

TABLE 3

| Sample No. | Plastic | W2 (gm) | W3 (gm) | W2 + W3 (gm) | W4 (gm) | Y2 (%) | W5 (gm) | Y3 (%) |
|---|---|---|---|---|---|---|---|---|
| 1 | HDPE | 293.3 | — | 293.3 | 244.9 | 83.5 | 34.3 | 11.7 |
| 2 | HDPE | 281.6 | — | 281.6 | 243.1 | 86.3 | 24.0 | 8.5 |
| 3 | HDPE | 280.2 | — | 280.2 | 217.4 | 77.6 | 62.8 | 22.4 |
| 4 | HDPE | 249.7 | 119.2 | 368.0 | 242.2 | 65.8 | 109.0 | 29.6 |
| 5 | HDPE | 255.8 | 57.8 | 313.6 | 256.7 | 81.9 | 56.0 | 17.9 |
| 6 | LDPE | 214.3 | — | 214.3 | 171.6 | 80.1 | 27.0 | 12.6 |
| 7 | LDPE | 211.8 | — | 211.8 | 152.3 | 71.9 | 50.9 | 24.0 |
| 8 | LDPE | 175.7 | 50.9 | 175.7 | 141.0 | 80.2 | 77.7 | 44.2 |
| 9 | PP | 172.4 | — | 172.4 | 156.8 | 91.0 | 11.6 | 6.7 |
| 10 | PP | 211.9 | — | 211.9 | 182.2 | 86.0 | 23.6 | 11.1 |
| 11 | PP | 252.3 | 23.6 | 275.9 | 246.7 | 89.4 | 24.7 | 8.6 |
| 12 | PP | 119.3 | — | 119.3 | 84.5 | 70.8 | 30.0 | 25.1 |
| 13 | PP | 258.9 | 24.7 | 283.6 | 253.9 | 89.5 | 23.9 | 8.4 |
| 14 | HDPE | 174.1 | — | 174.1 | 138.6 | 79.6 | 30.0 | 17.2 |
| 15 | PP | 87.7 | — | 87.7 | 69.1 | 78.8 | 14.5 | 16.5 |
| 16 | LDPE | 170.0 | — | 170.0 | 78.5 | 46.2 | 89.3 | 52.5 |
| 17 | HDPE | 189.1 | — | 189.1 | 134.2 | 70.1 | 50.7 | 26.8 |
| 18 | LDPE | 216.4 | — | 216.4 | 144.1 | 66.6 | 63.0 | 29.1 |
| 19 | Group 3 | 350.0 | — | 350.0 | 295.2 | 84.3 | 45.0 | 12.9 |
| 20 | PS | 239.6 | — | 239.6 | 162.8 | 67.9 | 60.1 | 25.1 |
| 21 | PS | 372.4 | — | 372.4 | 321.6 | 86.3 | 46.9 | 12.6 |
| 22 | PS | 163.5 | 60.1 | 223.5 | 135.8 | 60.8 | 86.9 | 38.9 |
| 23 | PS | 219.4 | — | 219.4 | 150.3 | 68.5 | 68.4 | 31.2 |
| 24 | PS | 97.7 | 68.4 | 166.1 | 98.6 | 59.3 | 64.5 | 38.8 |
| 25 | PS | 257.0 | 64.5 | 321.5 | 233.0 | 72.5 | 83.6 | 26.0 |
| 26 | PS | 199.3 | 93.6 | 292.9 | 163.3 | 55.8 | 127.7 | 43.6 |
| 28 | Group 3 | 231.9 | — | 231.9 | 178.2 | 76.8 | 49.5 | 21.3 |
| 29 | Group 3 | 250.8 | — | 250.8 | 206.8 | 82.4 | 42.0 | 16.7 |
| 30 | Group 3 | 280.8 | 39.5 | 320.3 | 207.2 | 64.7 | 109.8 | 34.2 |
| 31 | Group 9, 10 | 185.8 | — | 185.8 | 136.1 | 73.3 | 46.5 | 25.0 |
| 32 | Group 9, 10 | 143.1 | 46.5 | 189.6 | 108.1 | 57.0 | 75.4 | 39.8 |
| 33 | Group 9, 10 | 166 | — | 166 | 108.5 | 65.3 | 51.9 | 31.2 |
| 34 | Group 9, 10 | 188.1 | — | 188.1 | 139.9 | 74.4 | 43.2 | 23.0 |
| 35 | Group 9, 10 | 240.9 | — | 240.9 | 189.2 | 78.5 | 48.5 | 20.1 |
| 36 | Group 9, 10 | 310.5 | — | 310.5 | 153.7 | 49.5 | 155.5 | 50.1 |
| 37 | (Black hanger) | 183.1 | — | 183.1 | 98.6 | 5308 | 76.7 | 41.9 |
| 38 | LDPE (g.bin) | 275.3 | — | 275.3 | 233.7 | 84.9 | 27.2 | 9.9 |
| 39 | LDPE (g.bin) | 321.3 | — | 321.3 | 251.9 | 78.4 | 51.6 | 16.1 |
| 40 | LDPE (g.bin) | 327.4 | — | 327.4 | 275.1 | 84.0 | 35.7 | 10.9 |
| 41 | LDPE (g.bin) | 315.4 | — | 315.4 | 266.4 | 84.4 | 30.1 | 9.5 |
| 42 | LDPE (g.bin) | 353.7 | — | 353.7 | 308.7 | 87.3 | 25.5 | 16.1 |
| 43 | Group 8 | 267.7 | — | 267.7 | 224.3 | 83.8 | 42.9 | 16.0 |
| 44 | Group 8 | 413.0 | — | 413.0 | 324.9 | 78.7 | 85.5 | 20.7 |
| 45 | Group 5 | 211.3 | — | 211.3 | 163.0 | 77.1 | 47.6 | 22.5 |
| 46 | HDPE | 250.0 | — | 250.0 | 209.5 | 83.8 | 30.6 | 12.2 |
| 47 | PS | 246.7 | — | 246.7 | 186.6 | 75.6 | 55.8 | 22.6 |
| 48 | Group 5 | 219.7 | — | 219.7 | 182.3 | 83.0 | 27.4 | 12.4 |
| 49 | Group 5 | 228.3 | 27.4 | 255.7 | 197.9 | 77.4 | 42.3 | 16.5 |
| 50 | Group 5 | 194.2 | — | 194.2 | 151.0 | 77.8 | 31.8 | 16.4 |
| 51 | Group 5 | 225.3 | — | 225.3 | 184.7 | 82.0 | 27.4 | 12.1 |
| 52 | Group 4 | 201.2 | — | 201.2 | 162.4 | 80.7 | 24.6 | 12.2 |
| 53 | Group 4 | 234.9 | — | 234.9 | 159.7 | 68.0 | 58.2 | 24.8 |
| 54 | Group 4 | 223.0 | — | 223.0 | 174.5 | 78.2 | 36.7 | 16.5 |
| 55 | Group 4 | 203.9 | 24.6 | 228.5 | 171.3 | 75.0 | 44.6 | 19.5 |
| 56 | Group 4 | 197.9 | — | 197.9 | 137.9 | 69.7 | 50.7 | 25.6 |
| 57 | Group 4 | 188.2 | — | 188.2 | 136.8 | 72.7 | 40.7 | 21.6 |
| 58 | Group 6 | 220.7 | — | 220.7 | 162.7 | 73.7 | 42.8 | 19.4 |
| 59 | Group 6 | 245.6 | — | 245.6 | 192.9 | 78.5 | 41.1 | 16.7 |
| 60 | Group 6 | 185.8 | — | 185.8 | 147.0 | 79.1 | 24.9 | 13.4 |
| 61 | Group 6 | 183.4 | — | 183.4 | 128.7 | 70.2 | 50.4 | 27.4 |

TABLE 3-continued

| Sample No. | Plastic | W2 (gm) | W3 (gm) | W2 + W3 (gm) | W4 (gm) | Y2 (%) | W5 (gm) | Y3 (%) |
|---|---|---|---|---|---|---|---|---|
| 62 | Group 11 | 203.0 | — | 203.0 | 137.1 | 67.5 | 52.6 | 25.9 |
| 63 | Group 11 | 209.1 | — | 209.1 | 147.2 | 70.4 | 52.3 | 25.0 |
| 64 | Group 11 | 186.9 | — | 186.9 | 137.7 | 73.7 | 35.9 | 19.2 |
| 65 | Group 11 | 214.7 | — | 214.7 | 158.2 | 73.7 | 42.3 | 19.7 |
| 66 | Group 11 | 229.5 | — | 229.5 | 171.4 | 74.7 | 43.4 | 18.9 |
| 67 | Group 11 | 218.4 | — | 218.4 | 159.1 | 72.8 | 43.6 | 20.0 |
| 68 | Group 11 | 233.3 | — | 233.3 | 169.0 | 72.4 | 49.9 | 21.3 |
| 69 | LDPE, HDPE, PP, PS | 293.1 | — | 293.1 | 250.8 | 85.6 | 24.9 | 8.5 |
| 70 | Group 2 | 54.7 | — | 54.7 | 22.9 | 41.9 | 31.2 | 57.0 |
| 71 | Group 1 | 58.7 | — | 58.7 | 22.5 | 38.3 | 35.4 | 60.3 |

EXAMPLE 2

Section 3, Select Samples—Split-Process Recovered Slurry Recycling

As seen in Table 3 above, old (previously recovered residual) slurry was added to the fresh slurry prior to condensation in some, but not all, of the samples. The impact of recycling old slurry back into fresh slurry prior to condensation for these select samples, in the absence of controls, is evaluated in Table 4 below first in terms (yes or no) of whether the amount of old slurry (W3) added to the fresh slurry (W2) prior to condensation is greater than the amount of the recovered post-condensation slurry (W5). In the "yes" samples, namely samples 4, 5, 13 and 24, which represent four out of fourteen samples or 28.6 percent of the samples, the amount of old slurry (W3) is greater than the amount of the recovered post-condensation slurry (W5), and therefore the decreased net residual slurry establishes both that (a) some amount of residual hydrocarbon was present in the old slurry, and (b) some amount of such residual hydrocarbon was distilled. Since slurry is always left over after the catalyzed distillation/condensation step, for instance in percentage yields as low as 6.7, 8.4, 8.5 and 8.5 seen for samples 9, 13, 2 and 69 respectively in Table 3 above, and in percentage yields as high as 50.1, 52.5, 57.0 and 60.3 seen for samples 36, 16, 70 and 71 respectively, it is probable that further condensate is being produced from the old slurry (even when no net slurry decrease is seen) when the amount of old slurry plus a fraction of fresh slurry are in combination greater than the recovered post-condensation slurry. Therefore the same type of comparison is also shown in Table 4 below with "a" and "b" amounts of the fresh slurry added to the old slurry (W3) before comparison to the post-condensation recovered slurry (W5), wherein "a" and "b" are fractions of the fresh slurry in the particular sample. Specifically "a" is ten weight percent (0.1) and "b" twenty weight percent (0.2) of the fresh slurry, both in grams. As shown in Table 4 below, the combination of old slurry plus ten weight percent of the fresh slurry is, in combination, more than the post-condensation recovered slurry in seven of the fourteen samples. Also as shown in Table 4 below, the combination of old slurry plus twenty weight percent of the fresh slurry is, in combination, more than the post-condensation recovered slurry in eleven of the fourteen samples. These comparisons concern probabilities, and do not (and are not intended to) establish the contrary, namely that the samples which do not show a "yes" result at any level presented show negative results. Instead, the condensates recovered in such examples might nonetheless be, and probably are, derived in part from the old slurry. The data available, in the absence of controls or any tagging procedure, does not establish what proportion of the old slurries was recovered as hydrocarbon condensate. The sample identifications listed in Table 4 below are already discussed above for the data listed in Table 2.

TABLE 4

| Sample No. | Plastic | W2 (gm) | W3 (gm) | W5 (gm) | W3 > W5 | (W3 + a) > W5 | (W3 + b) > W5 |
|---|---|---|---|---|---|---|---|
| 4 | HDPE | 249.7 | 119.2 | 109.0 | Yes | Yes | Yes |
| 5 | HDPE | 255.8 | 57.8 | 56.0 | Yes | Yes | Yes |
| 8 | LDPE | 175.7 | 50.9 | 77.7 | No | No | Yes |
| 11 | PP | 252.3 | 23.6 | 24.7 | No | Yes | Yes |
| 13 | PP | 258.9 | 24.7 | 23.9 | Yes | Yes | Yes |
| 22 | PS | 163.5 | 60.1 | 86.9 | No | No | Yes |
| 24 | PS | 97.7 | 68.4 | 64.5 | Yes | Yes | Yes |
| 25 | PS | 257.0 | 64.5 | 83.6 | No | No | Yes |
| 26 | PS | 199.3 | 93.6 | 127.7 | No | No | Yes |
| 30 | Group 3 | 280.8 | 39.5 | 109.8 | No | No | No |
| 32 | Group 9, 10 | 143.1 | 46.5 | 75.4 | No | No | No |
| 49 | Group 5 | 228.3 | 27.4 | 42.3 | No | Yes | Yes |
| 55 | Group 4 | 203.9 | 24.6 | 44.6 | No | Yes | Yes |

In preferred embodiments of the present process, old slurries are recurrently recycled back into the process, by adding them to fresh slurries prior to their introduction to the catalyzed distillation/condensation step, until the approach of slurry exhaustion or the point at which a residual slurry contains so high a proportion on non-hydrocarbon material that its discard or other use is more reasonable.

Identification of Groups

The plastic samples used in Example 2 above and identified by "Group" numbers are further described in Table 5 below.

TABLE 5

| Group | Description |
|---|---|
| 1 | Combination of black vehicular headlight bulb holder, colored rubber-type telephone key pad, transparent vehicular headlight cover |
| 2 | Transparent hard cover (viz. microwave oven) |
| 3 | Combination of cylinder lattice cover, green soft plastics, white soft plastics, black frying pan handle, yellow plastic bag, plastic bag with red print, plastic bag with white and yellow printing |
| 4 | Combination of black plastic pen, green plastic straw, transparent soft plastics (2), air-filled plastic buttons and white translucent plastic cover. |
| 5 | Combination of grey plastic bags with black printing, transparent plastics, plastic cover, hard transparent plastics with red writing thereon, transparent |

TABLE 5-continued

| Group | Description |
|---|---|
| | hard plastic box cover, green wire-like plastic packing and yellow, printed cat-litter plastic bag |
| 6 | Combination of transparent Coca Cola ® bottle, soft transparent plastics, white disposable plastic plate, grey telephone body and transparent plastics. |
| 8 | Combination of hard transparent hanger, printed shopping bag and covers, transparent plastics, hard stick, hard box (viz. microwave oven), printed plastic picture, cassette tape covers, vehicular bumper portion. |
| 9 | Combination of plastic fork and spoon, and hard transparent plastics |
| 10 | Combination of plastic fork, food box cover, color-printed hard plastics, red packing thread, transparent packing strap, grey telephone antenna, transparent vehicular headlight-cover backs, with and without mercury. |
| 11 | Combination of white shampoo bottle cap and hard transparent plastics |

EXAMPLES 3-7

Overview

In each Examples 3 to 7 below, recovered condensates, which had been produced as described in Examples 1 and 2 above, were successfully tested for their values as a liquid hydrocarbon fuel by operating a number of devices using the condensates as the operating fuel. The types of devices, the amounts of condensates put into the devices and descriptions of the successful operations of the devices, are set forth below in the specific Examples.

EXAMPLE 3

One liter of recovered condensate was put into the otherwise empty fuel reservoir of a gasoline generator, and the generator operated for over an hour, producing electricity, using the condensate as its only fuel source. During this operation the generator was successfully used to power a light bulb and run a small portable refrigerator.

EXAMPLE 4

One-half liter of recovered condensate was put into the otherwise empty fuel reservoir of a gasoline lawn mower, and the lawn mower ran smoothly, with its wheels revolving, using this fuel without any black-smoke emissions.

EXAMPLE 5

One-half liter of recovered condensate was put into the otherwise empty fuel reservoir of a small gasoline generator, and the generator ran smoothly on this fuel without any black-smoke emissions.

EXAMPLE 6

One-half liter of recovered condensate was put into the otherwise empty fuel reservoir of a small older-model portable motor, and the motor ran smoothly on this fuel without any black-smoke emissions.

EXAMPLE 7

Four liters of recovered condensate above was put into the otherwise empty fuel reservoir of a 1984-model automobile, and the car was driven on this fuel with a driver and passenger without any problems.

Characterization of Condensate Produced as Described in Examples 1 and 2

Characterization studies by gas chromatography (GC) and gas chromatograph-mass spectrum (GC-MS) indicate that the condensate of the present invention, produced as described in Examples 1 and 2 above, which is a depolymerization product, is composed of essentially all straight-chain hydrocarbons when linear thermoplastic plastics (polymers) are used as the feed. Both GC and DSC studies indicate that the condensate includes hydrocarbons ranging from C3 to C27, which is the hydrocarbon carbon-chain length range that covers automotive gasoline and diesel fuel. The condensate contains lesser concentrations of aromatics (benzene, toluene, styrene, xylene, naphthalene and the like) than automotive gasoline and further, unlike gasoline, the condensate contains no sulfur from which can be derived harmful sulfur dioxide emissions.

EXAMPLE 8

A variety of pre-weighed samples of waste plastics were heated without external agitation in a vessel which was open only to a water-cooled condenser. The heating was achieved for each sample with a standard heating mantle regulated with a standard Variac (variable electrical transformer), although various heat mantles (described below) were used. In each instance, the plastics melted, vapor was released from the plastic melt into the condenser and condensed therein. The condensate was collected and weighed. The weight of the residue left in the vessel after process completion was weighed. The amount of material lost as a vapor, that is, lost to the system in a gaseous state, was calculated by subtracting the combined weights of the residue and condensate from the weight of the waste-plastic sample used. Set forth in Table 8 below are: the type and proportion of plastic(s) in each sample (explained further below); the original plastic sample weight ("Ws") in grams; the resultant condensate weight ("Wc") in grams, condensate volume ("Vc") in milliliters, and condensate density ("Dc") in grams per milliliter; the resultant residue weight ("Wr") in grams; the weight lost as gaseous material ("W↑") in grams; the condensate yield ("Yc") in weight percent (Wc/Ws×100); the gaseous-material loss yield Y↑ in weight percent (W↑/Ws×100); and the adjusted condensate yield ("Ya") in weight percent (Wc/(Ws−Wr)×100). Each sample is identified below by sample number ("S#"). The sample mixtures of plastics ("Mix") are identified in Table 8: by whether they were non-coded ("nc") or coded ("c") plastics or a mixture of non-coded and coded ("nc,c") plastics; by whether they were a random ("r") mixture of the different plastics (that is, in unspecified proportions) or an equal (equal proportion) ("ep") mixture (namely, in equal amounts by weight) or a single ("s") type of plastic; and, for coded plastics, the identification of the plastic or plastic mixture ("Mix") by the "mix" identification, namely, "mix-1" is a mixture of HDPE2 and PS6; and "mix-2" is a mixture of LDPE4, HDPE2, PP5 and PS6. For example, the plastic mixture of Sample 48 is identified as "c/ep mix-2" which means that the plastic was coded plastic of the four mix-2 plastics used in equal amounts, and since a total of 200 grams of plastic was used, the table data informs that 50 grams of each mix-2 plastic was used. When a single coded plastic was used, that plastic is identified by its abbreviation in the "Mix" column. Also identified in Table 8 below is whether or not a cracking catalyst was used, with "y" indicating that yes a catalyst was used and "n" indicating that no a catalyst was not used, both in the "Cat." Column. Further, shown in Table 8a below are the identifications of the Variac parameters as to process-start point (in percentage of the Variac range) and as to heating-mantle temperatures provided therewith, in ° C., at the start of the process ("Start T."), at the optimum point of the process ("Optimum T.", which is 70% of the Variac setting in all instances) and at the completion of the process ("End T.", which is 95% of the Variac setting in all instances except Sample #37 in which it was 90% and Samples #35, 36, 55-66, 71 and 73-75 in which it was 100%) for each sample, and the characteristics of heating mantle used ("Mantle"), namely: a one liter heating mantle which had a heating temperature range of from 0° to 450° C.; a five liter heating mantle which had a heating temperature range of from 0° to 650° C.; and a twelve liter heating mantle which had a heating temperature range of from 0° to 950° C. The samples in Table 8a are the samples of Table 8.

TABLE 8

Melt, Distill and Condense Process

| S# | Mix | Cat. | Ws (gm) | Wc (gm) | Vc (ml) | Dc (gm/ml) | Wr (gm) | W↑ (gm) | Yc (%) | Y↑ (%) | Ya (%) |
|---|---|---|---|---|---|---|---|---|---|---|---|
| 1 | nc/r | y | 240.2 | 34.9 | 42 | 0.83 | 169.9 | 35.4 | 14.5 | 14.7 | 49.6 |
| 2 | nc/r | y | 100 | 46.2 | 48 | 0.96 | 46.4 | 7.4 | 46.2 | 7.4 | 86.2 |
| 3 | nc/r | y | 205.5 | 156.6 | 206 | 0.76 | 40.8 | 8.1 | 76.2 | 3.9 | 95.1 |
| 4 | nc/r | y | 201.1 | 132.4 | 170 | 0.78 | 58.1 | 10.6 | 65.8 | 5.3 | 92.6 |
| 5 | nc/r | y | 1513.5 | 1080.5 | 1426 | 0.76 | 390.4 | 42.6 | 71.4 | 2.8 | 96.2 |
| 6 | nc/r | y | 2017.2 | 1415.9 | 1855 | 0.76 | 331.4 | 269.9 | 70.3 | 13.4 | 84.0 |
| 7 | nc/r | y | 2059.5 | 1073.0 | 1406 | 0.76 | 512 | 474.5 | 52.1 | 23.0 | 69.3 |
| 8 | nc/r | y | 350 | 307.1 | 405 | 0.76 | 33.1 | 9.8 | 87.7 | 2.8 | 96.9 |
| 9 | nc/r | y | 398.3 | 323 | 429 | 0.75 | 48.6 | 26.7 | 81.1 | 6.7 | 92.4 |
| 10 | nc/r | n | 350 | 312.8 | 415 | 0.75 | 23.5 | 13.7 | 89.4 | 3.9 | 95.8 |
| 11 | c/s PP5 | y | 419.8 | 353.7 | 465 | 0.76 | 45.8 | 20.3 | 84.2 | 4.8 | 94.6 |
| 12 | nc/r | y | 416.9 | 316.8 | 417 | 0.76 | 25.5 | 74.6 | 76.0 | 17.9 | 80.9 |
| 13 | c/s PS6 | n | 390 | 263.3 | 295 | 0.89 | 103.9 | 22.8 | 67.5 | 5.8 | 92.0 |
| 14 | c/s PS6 | y | 224.9 | 86.8 | 97 | 0.89 | 130.2 | 7.9 | 38.6 | 3.5 | 91.6 |
| 15 | c/r | y | 948 | 447.1 | 523 | 0.85 | 473.4 | 27.5 | 47.2 | 2.9 | 94.2 |
| 16 | nc/r | n | 254 | 187.3 | 203 | 0.92 | 25.7 | 41 | 73.7 | 16.1 | 82.0 |
| 17 | nc/r | n | 281.7 | 198.8 | 258 | 0.77 | 61 | 21.9 | 70.6 | 7.8 | 89.7 |
| 18 | nc/r | n | 214.9 | 158.4 | 208 | 0.76 | 40.8 | 15.7 | 73.7 | 7.3 | 90.9 |
| 19 | nc/r | n | 274.3 | 106.5 | 110 | 0.97 | 138.8 | 29 | 38.8 | 10.6 | 78.5 |
| 20 | nc/r | n | 1001.1 | 517.3 | 667 | 0.77 | 394.2 | 89.6 | 51.7 | 9.0 | 85.2 |
| 21 | nc/r | n | 387.4 | 199.4 | 228 | 0.87 | 93.8 | 94.2 | 51.5 | 24.3 | 67.9 |
| 22 | nc/r | n | 345.7 | 219.4 | 250 | 0.88 | 91.5 | 34.8 | 63.5 | 10.1 | 86.3 |
| 23 | nc/r | n | 386.3 | 244.5 | 277 | 0.88 | 123.4 | 18.4 | 63.2 | 4.8 | 93.0 |
| 24 | nc/r | n | 1348.7 | 968.4 | 1235 | 0.78 | 262.2 | 118.1 | 71.8 | 8.8 | 89.1 |
| 25 | nc/r | n | 306.5 | 187.9 | 214 | 0.88 | 99.8 | 18.8 | 61.3 | 6.1 | 90.9 |
| 26 | nc/r | n | 1381.1 | 1123.8 | 1494 | 0.75 | 167.7 | 89.6 | 81.3 | 6.5 | 92.6 |
| 27 | c/s PAP | n | 282.3 | 232.8 | 312 | 0.75 | 38.8 | 10.7 | 82.5 | 3.8 | 95.6 |
| 28 | nc/r | n | 282.2 | 211.7 | 277 | 0.76 | 53.6 | 16.9 | 75.0 | 6.0 | 92.6 |
| 29 | nc, c/r | n | 202.3 | 131.2 | 152 | 0.86 | 68.4 | 2.7 | 64.9 | 1.3 | 98.0 |
| 30 | c/r mix-1 | n | 349.2 | 238.3 | 300 | 0.79 | 77.1 | 33.8 | 68.2 | 9.7 | 87.6 |
| 31 | c/r mix-2 | y | 200 | 147.3 | 182 | 0.80 | 45.4 | 7.3 | 73.6 | 3.6 | 95.2 |
| 32 | c/r mix-2 | y | 200 | 167.5 | 212 | 0.79 | 25.5 | 7 | 83.8 | 3.5 | 95.9 |
| 33 | c/r mix-2 | y | 200 | 152.7 | 194 | 0.79 | 40.9 | 6.4 | 76.3 | 3.2 | 95.9 |
| 34 | c/r mix-2 | y | 200 | 181.2 | 225 | 0.80 | 12.6 | 6.2 | 90.6 | 3.2 | 96.6 |
| 35 | c/ep mix-2 | y | 1000 | 802.4 | 1013 | 0.79 | 165 | 32.6 | 80.24 | 3.3 | 96.1 |
| 36 | c/r mix-2 | y | 765 | 531.4 | 667 | 0.80 | 201.6 | 32 | 69.4 | 4.2 | 94.3 |
| 37 | c/r mix-2 | y | 574.5 | 287.4 | 365 | 0.79 | 248.8 | 38.3 | 50.0 | 6.7 | 88.2 |
| 38 | c/r mix-2 | n | 200 | 167.4 | 212 | 0.79 | 22.5 | 10.1 | 83.7 | 5.6 | 94.3 |
| 39 | c/r mix-2 | n | 200 | 170.5 | 217 | 0.78 | 19.5 | 10 | 85.2 | 5.0 | 94.4 |

TABLE 8-continued

| Melt, Distill and Condense Process | | | | | | | | | | | |
|---|---|---|---|---|---|---|---|---|---|---|---|
| S# | Mix | Cat. | Ws (gm) | Wc (gm) | Vc (ml) | Dc (gm/ml) | Wr (gm) | W↑ (gm) | Yc (%) | Y↑ (%) | Ya (%) |
| 40 | c/r mix-2 | n | 200 | 162.7 | 206 | 0.79 | 32.6 | 4.7 | 81.3 | 2.4 | 97.2 |
| 41 | c/r mix-2 | n | 200 | 171 | 216 | 0.79 | 19.9 | 9.1 | 85.5 | 4.6 | 94.9 |
| 42 | c/r mix-2 | n | 219.9 | 174.7 | 222 | 0.79 | 31.9 | 13.3 | 79.4 | 6.0 | 92.9 |
| 43 | c/r mix-2 | n | 200 | 166.4 | 212 | 0.78 | 24 | 9.6 | 83.2 | 4.8 | 94.5 |
| 44 | c/ep mix-2 | n | 200 | 158.5 | 202 | 0.78 | 31.7 | 9.8 | 79.2 | 4.9 | 94.1 |
| 45 | c/ep mix-2 | n | 200 | 166.1 | 210 | 0.79 | 23.6 | 10.3 | 83.0 | 5.1 | 94.1 |
| 46 | c/r mix-2 | n | 225 | 191.8 | 242 | 0.79 | 15.9 | 17.3 | 85.2 | 7.7 | 91.7 |
| 47 | c/ep mix-2 | n | 200 | 176.7 | 224 | 0.79 | 13.9 | 9.4 | 88.3 | 4.7 | 94.9 |
| 48 | c/ep mix-2 | n | 200 | 166.1 | 210 | 0.79 | 23.4 | 10.5 | 83.0 | 5.3 | 94.0 |
| 49 | c/ep mix-2 | n | 200 | 163.1 | 207 | 0.79 | 26.7 | 10.2 | 81.6 | 5.1 | 94.1 |
| 50 | c/ep mix-2 | n | 200 | 149.1 | 190 | 0.78 | 40 | 10.9 | 74.6 | 5.4 | 93.1 |
| 51 | c/ep mix-2 | y | 260 | 211.2 | 267 | 0.79 | 33 | 15.8 | 81.2 | 6.1 | 93.0 |
| 52 | c/ep mix-2 | y | 260 | 208.7 | 264 | 0.79 | 36 | 15.3 | 80.3 | 5.9 | 93.1 |
| 53 | c/ep mix-2 | y | 260 | 186.8 | 263 | 0.79 | 30.9 | 42.3 | 71.8 | 16.3 | 81.5 |
| 54 | c/ep mix-2 | y | 260 | 215 | 270 | 0.80 | 32.2 | 12.8 | 82.7 | 4.9 | 94.3 |
| 55 | c/r mix-2 | n | 1200 | 1010.7 | 1280 | 0.79 | 128 | 61.3 | 84.2 | 5.1 | 94.3 |
| 56 | c/r mix-2 | n | 1200 | 870 | 1100 | 0.79 | 207.6 | 122.4 | 72.5 | 10.2 | 87.7 |
| 57 | c/r mix-2 | y | 1080 | 866.2 | 1100 | 0.79 | 176.6 | 37.2 | 80.2 | 3.4 | 95.9 |
| 58 | c/r mix-2 | y | 1200 | 1025.6 | 1293 | 0.79 | 144.2 | 30.2 | 85.5 | 2.5 | 97.1 |
| 59 | c/r mix-2 | y | 1376.6 | 978.6 | 1250 | 0.78 | 325.2 | 72.8 | 71.1 | 5.3 | 93.1 |
| 60 | c/r mix-2 | y | 1344.2 | 1042.4 | 1319 | 0.79 | 252.7 | 49.1 | 77.5 | 3.6 | 95.5 |
| 61 | nc/r | y | 3975 | 2946 | 3811 | 0.77 | 791.9 | 237.1 | 74.1 | 6.0 | 92.6 |
| 62 | c/r mix-2 | y | 1525.2 | 1159.1 | 1485 | 0.78 | 299.4 | 66.7 | 76.0 | 4.4 | 94.55 |
| 63 | c/r mix-2 | y | 1452.7 | 1086.9 | 1417 | 0.77 | 306.8 | 59 | 74.8 | 4.1 | 94.8 |
| 64 | nc/r | y | 4028.7 | 2850.8 | 3729 | 0.76 | 957.1 | 220.8 | 70.8 | 5.5 | 92.8 |
| 65 | c/r mix-2 | y | 1200 | 811.2 | 1052 | 0.77 | 235 | 153.8 | 67.6 | 12.8 | 84.0 |
| 66 | c/r mix-2 | y | 1515 | 1156.9 | 1480 | 0.78 | 235.2 | 122.9 | 67.6 | 8.1 | 90.4 |
| 67 | c/ep mix-2 | y | 300 | 250.9 | 315 | 0.80 | 42.4 | 6.7 | 83.6 | 2.2 | 97.4 |
| 68 | c/r mix-2 | y | 280 | 237.1 | 303 | 0.78 | 34.1 | 8.8 | 84.7 | 3.1 | 96.4 |
| 69 | c/r mix-2 | y | 280 | 236.7 | 300 | 0.79 | 31.5 | 11.8 | 84.5 | 4.2 | 95.2 |
| 70 | c/r mix-2 | y | 294.1 | 226.5 | 285 | 0.79 | 59.9 | 7.7 | 70.1 | 2.6 | 96.7 |
| 71 | c/r mix-2 | y | 1435 | 985 | 1275 | 0.77 | 365.9 | 84.1 | 68.6 | 5.9 | 92.1 |
| 72 | c/r mix-2 | y | 299.9 | 237.2 | 300 | 0.79 | 51.1 | 11.6 | 79.1 | 3.9 | 95.3 |
| 73 | c/r mix-2 | y | 1400 | 1117 | 1420 | 0.79 | 171.1 | 111.9 | 79.8 | 8.0 | 90.8 |
| 74 | c/r mix-2 | y | 1565.9 | 1012.5 | 1300 | 0.79 | 427.8 | 125.6 | 64.7 | 8.0 | 89.0 |
| 75 | c/r mix-2 | y | 1371.1 | 1028.1 | 1318 | 0.78 | 246.7 | 96.3 | 75.0 | 7.0 | 91.4 |
| 76 | c/ep mix-2 | y | 240 | 202.6 | 263 | 0.77 | 30.6 | 6.8 | 84.4 | 2.8 | 96.8 |
| 77 | c/ep mix-2 | y | 240 | 181.2 | 230 | 0.79 | 53.6 | 5.2 | 75.5 | 2.2 | 97.2 |

TABLE 8-continued

| Melt, Distill and Condense Process | | | | | | | | | | | |
|---|---|---|---|---|---|---|---|---|---|---|---|
| S# | Mix | Cat. | Ws (gm) | Wc (gm) | Vc (ml) | Dc (gm/ml) | Wr (gm) | W↑ (gm) | Yc (%) | Y↑ (%) | Ya (%) |
| 78 | c/ep mix-2 | y | 240 | 200.4 | 255 | 0.78 | 32.6 | 7 | 83.5 | 2.9 | 96.6 |
| 79 | c/ep mix-2 | y | 240 | 202.2 | 258 | 0.78 | 31.7 | 6.1 | 84.2 | 2.5 | 97.1 |
| 80 | c/ep mix-2 | y | 240 | 201.1 | 255 | 0.79 | 32.9 | 6 | 83.8 | 2.5 | 97.1 |
| 81 | c/ep mix-2 | y | 240 | 206.6 | 260 | 0.79 | 27.4 | 6 | 86.1 | 2.5 | 97.2 |
| 82 | c/ep | y | 240 | 197.9 | 250 | 0.79 | 36.2 | 5.9 | 82.4 | 2.5 | 97.1 |
| 83 | c/ep mix-2 | y | 240 | 200.5 | 253 | 0.79 | 33.4 | 6.1 | 83.5 | 2.5 | 97.0 |
| 84 | c/ep mix-2 | y | 240 | 191.3 | 242 | 0.79 | 43.1 | 5.6 | 79.7 | 2.3 | 97.2 |
| 85 | c/ep mix-2 | y | 240 | 198 | 250 | 0.79 | 35.6 | 6.4 | 82.5 | 2.7 | 97.0 |
| 86 | c/r mix-2 | y | 213 | 154.5 | 198 | 0.78 | 47.5 | 11.3 | 72.5 | 5.3 | 93.3 |

TABLE 8a

| Melt, Distill and Condense Process Process Temperatures and Mantle | | | | | |
|---|---|---|---|---|---|
| | Variac | | | | Mantle |
| Ex. 8 S# | Start (%) | Start T. (° C.) | Optimum T. (° C.) | End. T. (° C.) | (liter size) |
| 1 | 50% | 225 | 325 | 427.5 | one |
| 2 | 50% | 225 | 325 | 427.5 | one |
| 3 | 50% | 225 | 325 | 427.5 | one |
| 4 | 60% | 270 | 315 | 427.5 | one |
| 5 | 70% | 455 | 455 | 617.5 | five |
| 6 | 60% | 390 | 455 | 617.5 | five |
| 7 | 60% | 390 | 455 | 617.5 | five |
| 8 | 50% | 225 | 325 | 427.5 | one |
| 9 | 50% | 225 | 325 | 427.5 | one |
| 10 | 50% | 225 | 325 | 427.5 | one |
| 11 | 60% | 270 | 315 | 427.5 | one |
| 12 | 50% | 225 | 325 | 427.5 | one |
| 13 | 50% | 225 | 325 | 427.5 | one |
| 14 | 50% | 225 | 325 | 427.5 | one |
| 15 | 60% | 390 | 455 | 617.5 | five |
| 16 | 50% | 225 | 325 | 427.5 | one |
| 17 | 50% | 225 | 325 | 427.5 | one |
| 18 | 40% | 180 | 315 | 95 | one |
| 19 | 40% | 180 | 315 | 95 | one |
| 20 | 60% | 390 | 455 | 617.5 | one |
| 21 | 40% | 180 | 315 | 95 | one |
| 22 | 50% | 225 | 325 | 427.5 | one |
| 23 | 50% | 225 | 325 | 427.5 | one |
| 24 | 60% | 390 | 455 | 617.5 | five |
| 25 | 50% | 225 | 325 | 427.5 | one |
| 26 | 60% | 390 | 455 | 617.5 | five |
| 27 | 50% | 225 | 325 | 427.5 | one |
| 28 | 50% | 225 | 325 | 427.5 | one |
| 29 | 50% | 225 | 325 | 427.5 | one |
| 30 | 50% | 225 | 325 | 427.5 | one |
| 31 | 50% | 225 | 325 | 427.5 | one |
| 32 | 40% | 180 | 315 | 95 | one |
| 33 | 40% | 180 | 315 | 95 | one |
| 34 | 40% | 180 | 315 | 95 | one |
| 35 | 60% | 390 | 455 | 617.5 | five |
| 36 | 60% | 390 | 455 | 617.5 | five |
| 37 | 60% | 390 | 455 | 617.5 | one |
| 38 | 40% | 180 | 315 | 95 | one |
| 39 | 40% | 180 | 315 | 95 | one |
| 40 | 40% | 180 | 315 | 95 | one |
| 41 | 40% | 180 | 315 | 95 | one |
| 42 | 40% | 180 | 315 | 95 | one |
| 43 | 40% | 180 | 315 | 95 | one |
| 44 | 40% | 180 | 315 | 95 | one |

TABLE 8a-continued

| Melt, Distill and Condense Process Process Temperatures and Mantle | | | | | |
|---|---|---|---|---|---|
| | Variac | | | | Mantle |
| Ex. 8 S# | Start (%) | Start T. (° C.) | Optimum T. (° C.) | End. T. (° C.) | (liter size) |
| 45 | 40% | 180 | 315 | 95 | one |
| 46 | 40% | 180 | 315 | 95 | one |
| 47 | 40% | 180 | 315 | 95 | one |
| 48 | 40% | 180 | 315 | 95 | one |
| 49 | 40% | 180 | 315 | 95 | one |
| 50 | 40% | 180 | 315 | 95 | one |
| 51 | 40% | 180 | 315 | 95 | one |
| 52 | 40% | 180 | 315 | 95 | one |
| 53 | 40% | 180 | 315 | 95 | one |
| 54 | 40% | 180 | 315 | 95 | one |
| 55 | 60% | 390 | 455 | 617.5 | five |
| 56 | 60% | 390 | 455 | 617.5 | five |
| 57 | 60% | 390 | 455 | 617.5 | five |
| 58 | 60% | 390 | 455 | 617.5 | five |
| 59 | 60% | 390 | 455 | 617.5 | five |
| 60 | 60% | 390 | 455 | 617.5 | five |
| 61 | 60% | 570 | 665 | 950 | twelve |
| 62 | 60% | 390 | 455 | 617.5 | five |
| 63 | 60% | 390 | 455 | 617.5 | five |
| 64 | 60% | 570 | 665 | 950 | twelve |
| 65 | 60% | 390 | 455 | 617.5 | five |
| 66 | 60% | 390 | 455 | 617.5 | five |
| 67 | 40% | 180 | 315 | 95 | one |
| 68 | 40% | 180 | 315 | 95 | one |
| 69 | 40% | 180 | 315 | 95 | one |
| 70 | 40% | 180 | 315 | 95 | one |
| 71 | 60% | 390 | 455 | 617.5 | five |
| 72 | 40% | 180 | 315 | 95 | one |
| 73 | 60% | 390 | 455 | 617.5 | five |
| 74 | 60% | 390 | 455 | 617.5 | five |
| 75 | 60% | 390 | 455 | 617.5 | five |
| 76 | 40% | 180 | 315 | 95 | one |
| 77 | 40% | 180 | 315 | 95 | one |
| 78 | 40% | 180 | 315 | 95 | one |
| 79 | 40% | 180 | 315 | 95 | one |
| 80 | 40% | 180 | 315 | 95 | one |
| 81 | 40% | 180 | 315 | 95 | one |
| 82 | 40% | 180 | 315 | 95 | one |
| 83 | 40% | 180 | 315 | 95 | one |
| 84 | 40% | 180 | 315 | 95 | one |
| 85 | 40% | 180 | 315 | 95 | one |
| 86 | 40% | 180 | 315 | 95 | one |

EXAMPLE 9

A variety of pre-weighed samples of waste plastics were heated without external agitation in a vessel which was open only to a water-cooled condenser. The heating was achieved for each sample with a standard heating mantle regulated with a standard Variac (variable electrical transformer), although various heat mantles (described below) were used. In each instance, the plastics melted, vapor was released from the plastic melt into the condenser and condensed therein. The condensate was collected and weighed. The weight of the residue left in the vessel after process completion was weighed. The amount of material lost as a vapor, that is, lost to the system in a gaseous state, was calculated by subtracting the combined weights of the residue and condensate from the weight of the waste-plastic sample used. Set forth in Table 9 below are: the type and proportion of plastic(s) in each sample (explained further below); the original plastic sample weight ("Ws") in grams; the resultant condensate weight ("Wc") in grams, condensate volume ("Vc") in milliliters, and condensate density ("Dc") in grams per milliliter; the resultant residue weight ("Wr") in grams; the weight lost as gaseous material ("W↑") in grams; the condensate yield ("Yc") in weight percent (Wc/Ws×100); the gaseous-material loss yield Y↑ in weight percent (W↑/Ws×100); and the adjusted condensate yield ("Ya") in weight percent (Wc/(Ws−Wr)×100). Each sample is identified below by sample number ("S#"). The sample mixtures of plastics ("Mix") are identified in Table 8: by whether they were or coded ("c") plastics or, in one instance, a polybag; by whether they were a random ("r") mixture of the different plastics (that is, in unspecified proportions) or an unequally-proportioned ("u") mixture (namely, in known but unequal amounts by weight; and, for coded plastics, the identification of the plastic or plastic mixture ("Mix") by the "mix" identification, namely "mix-1" is a mixture of HDPE2 and PS6; and "mix-2" is a mixture of LDPE4, HDPE2, PP5 and PS6. For example, the plastic mixture of Sample 11 is identified as "dr mix-2" which means that the plastic was coded plastic of the four mix-2 plastics used in random proportions. The proportions used in the "c/u" mixtures are identified after Table 9a below. Also identified in Table 9 below is whether or not a cracking catalyst was used, with "y" indicating that yes a catalyst was used, in the "Cat." Column. Further, shown in Table 9a below are the identifications of the Variac parameters as to start, middle, optimum and end points ("start-end" in percentage of the Variac range) and as to heating-mantle temperatures used therewith, in ° C., at the start of the process ("Start T."), at the middle of the process ("Middle T."), at the optimum point of the process ("Optimum T.") and at the completion of the process ("End T.") for each sample, and the characteristics of heating mantle used ("Mantle"), namely: a one liter heating mantle which had a heating temperature range of from 0° to 450° C.; a five liter heating mantle which had a heating temperature range of from 0° to 650° C.; and a twelve liter heating mantle which had a heating temperature range of from 0° to 950° C. The samples in Table 9a are the same as those of Table 9.

TABLE 9

Melting/Vaporization/Condensation Process

| S# | Mix | Cat. | Ws (gm) | Wc (gm) | Vc (ml) | Dc (gm/ml) | Wr (gm) | W↑ (gm) | Yc (%) | Y↑ (%) | Ya (%) |
|---|---|---|---|---|---|---|---|---|---|---|---|
| 1 | c/u mix-2 | y | 1446.7 | 753.1 | 990.0 | 0.76 | 560.8 | 132.8 | 52.1 | 9.2 | 85.0 |
| 2 | c/u mix-2 | y | 1560.8 | 1030.8 | 1344.0 | 0.76 | 360.5 | 169.5 | 66.0 | 10.8 | 85.9 |
| 3 | c/u mix-2 | y | 3717.0 | 3173.6 | 4150.0 | 0.76 | 334.4 | 209.0 | 85.4 | 5.6 | 93.8 |
| 4 | c/r mix-2 | y | 4000.0 | 2533.2 | 3327.0 | 0.76 | 1247.3 | 219.5 | 63.3 | 5.5 | 92.0 |
| 5 | c/r mix-2 | y | 4813.1 | 3070.6 | 3942.0 | 0.77 | 990.6 | 75.9 | 63.8 | 1.6 | 80.3 |
| 6 | c/r mix-2 | y | 2017.0 | 1556.7 | 1925.0 | 0.80 | 320.4 | 139.9 | 77.2 | 6.9 | 91.8 |
| 7 | c/r mix-2 | y | 1868.8 | 1355.0 | 1777.0 | 0.76 | 393.9 | 119.9 | 72.5 | 6.4 | 91.9 |
| 8 | c/r mix-2 | y | 1709.3 | 1181.1 | 1492.0 | 0.79 | 438.5 | 89.7 | 69.1 | 5.2 | 92.9 |
| 9 | c/r mix-2 | y | 2038.5 | 1261.0 | 1650.0 | 0.76 | 516.9 | 260.6 | 61.9 | 12.8 | 82.9 |
| 10 | c/r mix-2 | y | 1826.7 | 1242.9 | 1698.0 | 0.73 | 440.5 | 143.3 | 68.0 | 7.8 | 89.7 |
| 11 | c/r mix-2 | y | 4592.5 | 3154.8 | 4093.0 | 0.77 | 802.2 | 635.5 | 68.7 | 13.8 | 83.2 |
| 12 | c/r mix-2 | y | 4042.2 | 3139.4 | 4108.0 | 0.76 | 486.6 | 416.2 | 77.7 | 1.9 | 88.2 |
| 13 | polybag | y | 610.6 | 216.9 | 285.0 | 0.76 | 359.8 | 33.9 | 35.5 | 5.5 | 86.5 |
| 14 | c/r mix-2 | y | 1522.3 | 1222.3 | 1626.0 | 0.75 | 212.6 | 87.4 | 80.3 | 5.7 | 93.3 |
| 15 | c/r mix-2 | y | 2183.0 | 1811.1 | 2350.0 | 0.77 | 148.4 | 223.5 | 83.0 | 10.2 | 89.0 |

TABLE 9a

Melt, Distill and Condense Process
Process Temperatures and Mantle

| Ex. 9 S# | Variac Start-End (%) | Start T. (° C.) | Middle T. (° C.) | Optimum T. (° C.) | End. T. (° C.) | Mantle (liter size) |
|---|---|---|---|---|---|---|
| 1 | 100, 40, 70, 90 | 650 | 260 | 455 | 585 | five |
| 2 | 100, 35, 70, 85 | 650 | 227.5 | 455 | 552.5 | five |
| 3 | 95, 45, 68, 80 | 902.5 | 427.5 | 646 | 760 | twelve |

TABLE 9a-continued

| Melt, Distill and Condense Process Process Temperatures and Mantle | | | | | | |
|---|---|---|---|---|---|---|
| | Variac | | | | | |
| Ex. 9 S# | Start-End (%) | Start T. (° C.) | Middle T. (° C.) | Optimum T. (° C.) | End. T. (° C.) | Mantle (liter size) |
| 4 | 95, 35, 70, 85 | 902.5 | 332.5 | 665 | 807.5 | twelve |
| 5 | 100, 45, 75, 90 | 950 | 427.5 | 712.5 | 855 | twelve |
| 6 | 100, 50, 65, 95 | 650 | 325 | 422.5 | 617.5 | five |
| 7 | 95, 40, 75, 85 | 617.5 | 260 | 487.5 | 552.5 | five |
| 8 | 100, 45, 70, 90 | 650 | 292.5 | 455 | 585 | five |
| 9 | 95, 35, 68, 80 | 617.5 | 227.5 | 442 | 520 | five |
| 10 | 100, 45, 70, 90 | 650 | 425 | 455 | 585 | five |
| 11 | 100, 50, 70, 85 | 950 | 425 | 665 | 807.5 | twelve |
| 12 | 95, 45, 75, 90 | 902.5 | 427.5 | 712.5 | 855 | twelve |
| 13 | 100, 48, 65, 80 | 650 | 312 | 422.5 | 520 | five |
| 14 | 95, 40, 75, 85 | 617.5 | 260 | 487.5 | 552.5 | five |
| 15 | 100, 45, 75, 90 | 650 | 292.5 | 487.5 | 585 | five |

The proportion of plastics in the non-random, but unequally-proportioned mix-2 Samples 1 to 3 shown in Table 9 above are, respectively, in grams, in the order of LDPE4, HDPE2, PP5 and PS6: 400/300/400/100; 300/300/300/100; and 779.0/1577.2/1315.9/44.9.

EXAMPLE 10

A sample of a condensate of the present invention produced by the process described in Examples 1 and 2 above was filtered and then, to obtain a double-distilled condensate, was taken through a second distillation/condensation process. The condensate sample, after filtration, was dark brown in color, and had a density of 0.77 g/ml. A measured amount, namely 750 ml. (575 grams) of the filtered condensate was placed in a boiling flask, distilled and the condensate therefrom was collected in a first and a second collection flask (first and second "collections"). The first collection, which was a collection of 400 ml. of double-distilled condensate, took about one hour, thirty minutes. The second collection, which was a collection of 309 ml. of double-distilled condensate, took about two hours. The yield of the combined double-distilled condensates ((400+309)/750×100) was 94.5%. A one ml. from each collection was subjected to a flame test in which it was exposed to a live flame, and its ignition and burn characteristics were noted and recorded. The characteristics of each collection, including the results of the flame tests, are set forth below in Table 10.

TABLE 10

| Parameter | First Collection | Second Collection |
|---|---|---|
| Density (grams/ml) | 0.74 | 0.79 |
| Color, appearance | light yellow, transparent | yellow, cloudy |
| Flame test - burn time | 1 min. 45 sec. | no ignition |
| Flame test - flame quality | very little black smoke, no carbon soot, good flame quality | no ignition |
| Flame test - after-burning residue | no residue | no ignition |

EXAMPLE 11 AND COMPARATIVE EXAMPLE 12

A sample of double-distilled condensate of the present invention was tested as a liquid automotive fuel by comparing its performance, in terms of mileage (miles-per-gallon, or mpg, output) and exhaust emissions, with that of a commercial grade of automotive gasoline. The automotive vehicle used to conduct this comparison was a 1984 Oldsmobile passenger vehicle ("car") equipped with a V-8 engine, which had an odometer-mileage (number of miles car had already driven) of 29,002.6 at the start of the tests. The tests of Example 11 and Comparative Example 12 were conducted as follows. First, all fuel was drained from the car's fuel tank and then one gallon of the fuel being tested, namely the double-distilled condensate of the present invention (Example 11), was injected into the car's fuel tank. Both tests were conducted with four people in the car while it was driven on a local road with an ENMET MX 2100 emission tester mounted about one foot away from the car's exhaust pipe. The car was driven at speeds up to about 55 mph, with an overall average speed of about 43 mph (18 miles covered in 25 minutes) until the fuel was exhausted and the car came to a full stop. At the point when the car came to a full stop in the test of Example 11, the odometer read 29020.6 miles, which indicated that the car had been driven 18.0 miles on the one gallon double-distilled condensate of the present invention. The exhaust emissions reading, described below, was recorded. Then for Comparative Example 12, one gallon of the commercial automotive gasoline was added to the car, and the car was driven using the same conditions. At the point when the car, which again was driven up to about 55 mph, ran out of gas and came to a full stop, the odometer read 29035.3 miles, which indicated that the car had been driven 14.7 miles in the test of Comparative Example 12, and that the overall average speed during the test was 38 mph (14.7 miles covered in 23 minutes). Therefore the mileage provided by the double-distilled condensate of the present invention (18 mpg) was about 22 percent higher than the mileage (14.7 mpg) provided by the commercial automotive gasoline. The exhaust emissions recorded during both tests are set forth below in Table 11. More detailed driving-speed logs for both tests are set forth below in Table 12 wherein equal elapsed times are set out juxtaposed to the extent practical, and zero speeds are explained below the table. From the logs of Table 11 it is seen that the car speed during the test of Example 11 averaged about 43 mph and that the car speed during the test of Comparative Example 12 averaged about 39 mph.

TABLE 11

| Recorded Exhaust Emissions | | |
|---|---|---|
| Emission Gas | Example 11 | Comparative Example 12 |
| CO | 1200 | 1200 |
| $H_2S$ | −3 | −2 |
| $O_2$ | 21.0 | 16.8 |
| $CH_4$ | 5 | 0 |

TABLE 12

| Log of Car Speeds | | | |
|---|---|---|---|
| Example 11 | | Comparative Example 12 | |
| Elapsed Time (min.) | Car Speed (mph) | Elapsed Time (min.) | Car Speed (mph) |
| 0 | 0 | 0 | 0 |
| 5 | 40 | 6 | 55 |
| 7 | 0 (3 sec.) | 8 | 40 |
| 8 | 50 | 9 | 0 (5 sec.) |
| 10 | 55 | 11 | 55 |

TABLE 12-continued

| Log of Car Speeds | | | |
|---|---|---|---|
| Example 11 | | Comparative Example 12 | |
| Elapsed Time (min.) | Car Speed (mph) | Elapsed Time (min.) | Car Speed (mph) |
| 12 | 55 | 13 | 50 |
| 15 | 45 | 15 | 55 |
| 17 | 45 | 18 | 40 |
| 20 | 0 (4 sec.) | 21 | 55 |
| 23 | 55 | 23 | 0 |
| 25 | 0 | | |

The zero mph at 0 elapsed times and at the end of the tests (25 and 223 minutes elapsed times respectively) signify the engine starts at the beginnings of the tests and the running out of gas occurrences at the conclusions of the tests, and between these events the zero mph records indicate stops at red lights for the time durations shown in parenthesis.

EXAMPLE 13

A waste-plastic melting/vaporization/condensation process of the present invention was tracked in detail, particularly regarding temperatures and the onset and continued progression of the vaporization/condensation stage. Temperatures were recorded by both the Variac setting (and presumed temperature of the heating mantle used) and the temperature of the waste-plastic sample as measured using a thermocouple having a temperature range of from about −200° C. to 13,700° C. The duration of the process was about four hours, thirty-five minutes. The process was conducted under a standard fume hood at ambient room temperature (about 21.9° C. to about 2.4° C.). The waste-plastic sample was 300.0 grams of a random mixture of LDPE, HDPE, PP and PS. The weight and volume of the condensate collected during the process was 230.3 grams and 315 ml respectively, which corresponds to a condensate yield (Yc) of 76.8 wt. percent and a condensate density (Dc) of 0.73 g/ml. The residue left in behind in the boiling vessel weighed 55.6 grams, and therefore the material lost as a non-condensed vapor was 14.1 grams. The Variac-regulated heating mantle temperatures, thermocouple-determined waste-plastic sample temperatures and process progress, particularly the progress of the vaporization/condensation, are set forth in Table 13 below versus elapsed time (which was primarily read at five-minute intervals) of the process. In more detail, the process progress is reported in Table 13 as to prior to any melting and vaporization of the plastic sample (elapsed time 1-10 min.), and then as to the onset and continuation of melting and vaporization prior to boiling (elapsed time 15-45 min.), and then as to melting and boiling prior to condensate formation and collection (elapsed time 50-65 min.), and then as to the formation of first condensate drop (at elapsed time of 70 min.), and thereafter as to the rate of condensate formation/collection in terms of drops per minute.

TABLE 13

| Elapsed Time (min.) | Variac setting (%) | Heat Mantle Temp. (° C.) | Thermocouple Temp. (° C.) | Process Progress |
|---|---|---|---|---|
| 0 | 0 | 0 | 0 | Plastic sample is solid |
| 1 | 90 | 405 | 21.9 | Plastic sample is solid |
| 5 | 90 | 405 | 222.4 | Plastic sample is solid |
| 10 | 90 | 405 | 222.9 | Plastic sample is solid |
| 15 | 90 | 405 | 223.1 | Melting/vaporization |
| 20 | 50 | 225 | 237.3 | Melting/vaporization |
| 25 | 30 | 135 | 291.4 | Melting/vaporization |
| 30 | 20 | 90 | 298.3 | Melting/vaporization |
| 35 | 30 | 135 | 323.4 | Melting/vaporization |
| 40 | 40 | 180 | 325.3 | Melting/vaporization |
| 45 | 40 | 180 | 343.4 | Melting/vaporization |
| 50 | 50 | 225 | 373.6 | Melting/boiling |
| 55 | 50 | 225 | 383.7 | Melting/boiling |
| 60 | 50 | 225 | 373.7 | Melting/boiling |
| 65 | 50 | 225 | 382.6 | Melting/boiling |
| 70 | 50 | 225 | 383.9 | First condensate drop |
| 75 | 50 | 225 | 393.0 | 8 drops/min. |
| 80 | 50 | 225 | 397.5 | 8 drops/min. |
| 85 | 60 | 270 | 403.6 | 8 drops/min. |
| 90 | 60 | 270 | 409.0 | 8 drops/min. |
| 95 | 70 | 315 | 411.9 | 12 drops/min. |
| 100 | 70 | 315 | 413.6 | 14 drops/min. |
| 105 | 80 | 360 | 426.2 | 16 drops/min. |
| 110 | 40 | 180 | 410.7 | 20 drops/min. |
| 115 | 40 | 180 | 406.2 | 16 drops/min. |
| 120 | 30 | 135 | 404.3 | 12 drops/min. |
| 125 | 30 | 135 | 402.1 | 10 drops/min. |
| 130 | 30 | 135 | 399.2 | 10 drops/min. |
| 135 | 30 | 135 | 389.5 | 8 drops/min. |
| 140 | 40 | 180 | 388.6 | 8 drops/min. |
| 145 | 50 | 225 | 389.1 | 16 drops/min. |
| 150 | 50 | 225 | 389.3 | 16 drops/min. |
| 155 | 60 | 270 | 390.7 | 22 drops/min. |
| 160 | 60 | 270 | 393.9 | 18 drops/min. |
| 165 | 60 | 270 | 400.0 | 36 drops/min. |
| 170 | 60 | 270 | 402.2 | 38 drops/min. |
| 175 | 60 | 270 | 405.1 | 40 drops/min. |
| 180 | 60 | 270 | 407.1 | 46 drops/min. |
| 185 | 60 | 270 | 411.0 | 62 drops/min. |
| 190 | 60 | 270 | 413.2 | 62 drops/min. |
| 195 | 60 | 270 | 414.5 | 62 drops/min. |
| 200 | 60 | 270 | 414.7 | 62 drops/min. |
| 205 | 60 | 270 | 411.8 | 62 drops/min. |
| 210 | 60 | 270 | 410.8 | 62 drops/min. |
| 215 | 60 | 270 | 411.9 | 62 drops/min. |
| 220 | 60 | 270 | 411.3 | 62 drops/min. |
| 225 | 60 | 270 | 405.8 | 22 drops/min. |
| 230 | 70 | 315 | 406.1 | 22 drops/min. |
| 235 | 70 | 315 | 404.1 | 22 drops/min. |
| 240 | 70 | 315 | 405.5 | 20 drops/min. |
| 245 | 70 | 315 | 409.7 | 20 drops/min. |
| 250 | 80 | 360 | 430.5 | 20 drops/min. |
| 255 | 80 | 360 | 435.7 | 74 drops/min. |
| 260 | 80 | 360 | 440.6 | 74 drops/min. |
| 265 | 80 | 360 | 446.6 | 74 drops/min. |
| 270 | 80 | 360 | 450.3 | 90 drops/min. |
| 275 | 80 | 360 | 452.4 | 90 drops/min. |

EXAMPLE 14

Samples of condensates of the present invention were compared to samples of commercial fuels as to color and appearance, density and Onset value in Table 14 below. The compositions of these materials are discussed below. The condensates of the present invention are identified as to the process of the present invention used to produce the condensates and as to plastic-waste materials used in producing the condensates. All of the plastic-waste materials used were random mixtures of the plastics identified in Table 14 below. Further, the melt/vaporization/condensation process of the present invention is identified in Table 14 as "basic". A fractional distillation process of the present invention is identified as "fractional" and then as to cut. A double distillation processing is identified as "double" and also as to whether it is from the "first" or the "second" collection as described in Example xx 6 above. Whether the sample was filtered or unfiltered after production is specified for some samples. Whether the condensate collection vessel was cooled or not is specified for some samples as "ice" of "w/o ice" for "with ice" and "without ice" respectively.

TABLE 14

| S# | Process or Commercial | Source of sample | Color/ Appearance | Density g/ml | Onset value ° C. |
|---|---|---|---|---|---|
| 1 | basic, unfiltered | LDPE, PP, PS and HDPE | Amber Color/ Transparent with very faint cloudy appearance | 0.77 | 121.20 |
| 2 | basic, filtered | LDPE, PP, PS and HDPE | Amber Color/ Not Fully Transparent with lots of settlement on bottom | 0.77 | 137.91 |
| 3 | fractional, bottom | LDPE, PP, PS and HDPE | Dark Yellow Color/ Transparent with few settlement on bottom | 0.77 | 136.01 |
| 4 | fractional, middle | LDPE, PP, PS and HDPE | Yellow Color/ Transparent with no settlement on bottom | 0.76 | 119.63 |
| 5 | fractional, top | LDPE, PP, PS and HDPE | Light Yellow Color/ Transparent with no settlement on bottom | 0.75 | 89.25 |
| 6 | fractional, topmost | LDPE, PP, PS and HDPE | White Color/ Fully Transparent with no settlement on bottom | 0.72 | N/A |
| 7 | double, first, w/o ice | LDPE, PP, PS and HDPE | Light Yellow Color/ Transparent with no settlement on bottom | 0.74 | 94.52 |
| 8 | double, second, w/o ice | LDPE, PP, PS and HDPE | Amber Color/ Not Fully Transparent with adequate settlement on bottom | 0.78 | 194.46 |
| 9 | double, first, ice | LDPE, PP, PS and HDPE | Light Yellow Color/ Transparent with no settlement on bottom | 0.74 | 93.67 |
| 10 | double, second, ice | LDPE, PP, PS and HDPE | Amber Color/ Not Fully Transparent with adequate settlement on bottom | 0.78 | 193.29 |
| 11 | commercial automotive gasoline | Fossil Fuel | Yellow Color/ Transparent with no settlement on bottom | 0.72-0.74 | 68.14 |
| 12 | commercial automotive diesel fuel | Fossil Fuel | Green Color/ Not Fully Transparent with no settlement on bottom | 0.78-0.80 | 226.71 |
| 13 | commercial aviation gasoline | Fossil Fuel | Dark Yellow Color/ Transparent with no settlement on bottom | 0.72-0.80 | 194.61 |

Commercial Automotive Gasoline: In comparison to the condensates of the present invention, the constituents (hydrocarbons) of commercial automotive gasoline can be characterized as of lower molecular weight and structural complexity because commercial gasoline completely volatilize by 220° C. For example, dodecane (C12H26), which is possibly the most complex and heavy gasoline hydrocarbon, boils at 216° C., and hexane to nonane (C6H14 to C9H20) boil at 68.7° C. and 150.8° C. respectively.

Basic, unfiltered sample: The constituents of this sample higher in molecular weight probably are more structurally complex in comparison to commercial automotive gasoline. It doesn't completely volatilize until approximately 300° C.

Aviation Fuel: Commercial aviation fuel are higher in molecular weight and more structurally complex than automotive gasoline.

Fractional, various layers: The constituents for the fractionally distilled condensate, bottom layer, are heavy in molecular weight and complex in molecular structure. The constituents don't completely volatilize until a temperature higher than 300° C. The constituents of the fractional middle layer sample are of lower molecular weight and less complex in molecular structure than the fractional bottom layer sample. The constituents of the fractional top layer sample are lower in molecular weight and less complex in molecular structure when compared to both fractional bottom and middle layer samples.

Double samples: The constituents for the double distilled condensate samples are lower in molecular weight and less structurally complex that the basic samples, either filtered or unfiltered. It is believed that the second vaporization step further breaks down the hydrocarbon constituents. The constituents of the second collection are higher in molecular weight and more structurally complex when compared with the first collection.

Commercial diesel fuel: The constituents of commercial diesel fuel are higher in molecular weight and more complex in molecular structure when compared to the other fuel samples listed in Table 14 above. It is believed that diesel fuel contains certain additives and/or some light hydrocarbon materials that enhance the cold startup for diesel-based engines.

EXAMPLE 15

One litter of double distilled condensate (first collection) was poured into Jiang Dong Generator to test its fuel performance. The following electrical appliances were run off the generator: 1500 watt heater (full heat); 1500 watt heater (medium heat); 225 watt fan; 65 watt laptop; and 100 watt bulb, An EML 2020 Energy Monitoring Logger was used to calculate the amount of electricity being consumed by these appliances. The generator ran for a total of 32 minutes at a peak output of around 2900 watts and a kilowatts hour rating of 1.480 kW (1.48 kWh×32=47.36 kilowatt output). The double distilled condensate ran the generator very smoothly. The generator did not shake, make any unusual sound, produce any black smoke or require starter fluid.

EXAMPLE 16

The energy consumed during a basic melt/vaporize/condense process of the present invention was determined as follows. A 240 gram mixed waste plastic sample (PP, HDPE 2, LDPE 4 and PS), after cleaning and shredding, underwent a basic melt/vaporize/condense process of the present invention (described in more detail above in Examples 8 and 9 above) was transferred into a round bottom flask (1000 ml) and then placed on a heat mantle controlled with a standard Variac. The plastic was heated, melted and vaporized. The vapor was condensed (via a standard water-cooled condenser) and the condensate was collected. The collected condensate obtained weighed 194.7 grams and has a volume of 252 ml. An energy monitoring logger was used to calculate the amount of watts being consumed for heating during the process, which continued for about three hours. In that three hour span a total of 0.830 kWh was consumed for heating which equates to 12.5 kWh per gallon consumed during the production. For comparison, it is noted that the energy content of a commercial automotive gasoline is about 36-37 kWh, which is about three times higher than the energy consumed in the basic process of the present invention.

The present method, as exemplified above, is a method for the production of a hydrocarbonaceous fluid from a feed of waste plastic. By hydrocarbonaceous fluid is meant herein a liquid mixture of hydrocarbons, or in other words a mixture of hydrocarbons which is liquid at ambient room temperature and atmospheric pressure. The method comprises in broad embodiments the steps of: (step 1) melting a feed of substantially solid waste plastic in an aerobic atmosphere (for instance, air) whereby a waste-plastic melt is produced; (step 2) distilling at least a portion of the waste-plastic melt whereby a hydrocarbonaceous distillate is produced; and (step 3) collecting the hydrocarbonaceous distillate. That distillate is generally referred to above as a condensate. In some preferred embodiments, the method includes the step of comminuting the feed of substantially solid waste plastic into pieces substantially no greater than about 1.5 $cm^2$ prior to step 1. In preferred embodiments, the method includes the step of adding an effective amount of a cracking catalyst to the waste plastic prior to step 2.

Also in certain preferred embodiments, step 1 and step 2 are performed by the steps of: (step a) heating the feed of substantially solid waste plastic in an aerobic atmosphere in a vessel to melt and volatilize at least a portion of the feed of waste plastic to form a stream of volatiles; and (step b) condensing the volatiles. This preferred embodiment is particularly exemplified in Examples 8 and 9 above.

In preferred embodiments, the feed of waste plastic is substantially a feed of linear, thermoplastic polymer, including but not limited to feeds of waste plastic selected from the group consisting of high-density polyethylene, low-density polyethylene, polypropylene and mixtures thereof.

In some of the preferred embodiments, the method includes the step of (step 4) after step 3, filtering the distillate. In some of the preferred embodiments, the method includes the steps of: (step 4) after step 3, filtering the distillate to produce a filtrate; and (step 5) distilling the filtrate to produce a refined filtrate. In some of the preferred embodiments, the method includes the steps of: (step 4) after step 3, filtering the distillate to produce a filtrate; (step 5) distilling the filtrate to produce a refined filtrate; and (step 6) separately collecting a first fraction of the refined filtrate, such as exemplified above. In some of the preferred embodiments, the method includes the steps of: prior to the step 2, adding an effective amount of a cracking catalyst to the waste plastic; (step 4) after step 3, filtering the distillate to produce a filtrate; (step 5) distilling the filtrate to produce a refined filtrate; and (step 6) separately collecting a first fraction of the refined filtrate.

The present invention also includes, as exemplified above, a hydrocarbonaceous fluid produced according to the method of the invention, and containing hydrocarbons within the liquid hydrocarbon fuel range, which is described above While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

I claim:

1. A method for the production of a hydrocarbonaceous fluid from a feed of waste plastic comprising:

(a) melting a feed of substantially solid waste plastic in an aerobic atmosphere whereby a waste-plastic melt is produced;

(b) in said aerobic atmosphere, thermally decomposing plastic in said waste-plastic melt;

(c) distilling at least a portion of said waste-plastic melt whereby a hydrocarbonaceous distillate is produced; and (d) collecting said hydrocarbonaceous distillate, wherein the energy supplied for said melting and distilling is no more than about 12.5 kWh per gallon of said hydrocarbonaceous distillate produced.

2. The method according to claim 1 further including:

prior to (a), comminuting said feed of substantially solid waste plastic into pieces substantially no greater than about 1.5 $cm^2$.

3. The method according to claim 1 further including:

prior to (c), adding an effective amount of a cracking catalyst to said waste-plastic melt.

4. The method according to claim 1, wherein (a), (b) and (c) are performed by:

(i) heating said feed of substantially solid waste plastic in an aerobic atmosphere in a vessel to melt and volatilize at least a portion of said feed of substantially solid waste plastic to produce a stream of volatiles; and (ii) condensing said stream of volatiles.

5. The method according to claim 1 wherein, in (a), said feed of substantially-solid waste plastic is substantially a feed of linear, thermoplastic polymer.

6. The method according to claim 1 wherein, in (a), said feed of substantially-solid waste plastic is substantially a feed of waste plastic selected from the group consisting of high-density polyethylene, low-density polyethylene, polypropylene and mixtures thereof.

7. The method according to claim 1 further including:

(e) filtering said distillate.

8. The method according to claim 1 further including:

(e) filtering said distillate to produce a filtrate; and (f) distilling said filtrate to produce a refined filtrate.

9. The method according to claim 1 further including:

(e) filtering said distillate to produce a filtrate;

(f) distilling said filtrate to produce a refined filtrate; and (g) separately collecting a first fraction of said refined filtrate.

10. The method according to claim 1 further including:

prior to (c), adding an effective amount of a cracking catalyst to said waste plastic;

(e) filtering said distillate to produce a filtrate;

(f) distilling said filtrate to produce a refined filtrate; and (g) separately collecting a first fraction of said refined filtrate.

11. A hydrocarbonaceous fluid produced according to the method of claim 1 and containing hydrocarbons within the liquid hydrocarbon fuel range.

12. A hydrocarbonaceous fluid produced according to the method of claim 9 and containing hydrocarbons within the liquid hydrocarbon fuel range.

13. A method for producing a fuel, comprising:

melting a substantially solid waste plastic material in an aerobic atmosphere in a vessel to produce a melted plastic feed material; and in the aerobic atmosphere, heating the melted plastic feed material in the presence of a catalyst to form a liquid hydrocarbon fuel and a residual hydrocarbon, wherein the energy supplied for said melting and heating is no more than about 12.5 kWh per gallon of liquid hydrocarbon fuel produced.

14. The method of claim 13, further comprising combining the melted plastic feed material with a second residual hydrocarbon prior to heating the melted plastic feed material.

15. The method of claim 13, wherein the substantially solid waste plastic material comprises polyethylene.

16. The method of claim 13, further comprising distilling the residual hydrocarbon.

17. A method for producing a fuel, comprising:

melting a substantially solid waste plastic material in an aerobic atmosphere in a vessel to produce a melted plastic feed material; and in the aerobic atmosphere, heating the melted plastic feed material in the presence of a catalyst to form a liquid hydrocarbon fuel and a residual hydrocarbon, wherein the mass of the liquid hydrocarbon fuel is at least about 85% of the plastic material.

18. The method of claim 17, further comprising combining the melted plastic feed material with a second residual hydrocarbon prior to heating the melted plastic feed material.

19. The method of claim 17, wherein the substantially solid waste plastic material comprises polyethylene.

20. The method of claim 17, further comprising distilling the residual hydrocarbon.

21. The method of claim 1, wherein said feed of substantially solid waste plastic is melted without adding a catalyst.

* * * * *